US009733583B2

(12) United States Patent
Kuroki et al.

(10) Patent No.: US 9,733,583 B2
(45) Date of Patent: Aug. 15, 2017

(54) TONER

(71) Applicant: CANON KABUSHIKI KAISHA, Tokyo (JP)

(72) Inventors: Shiro Kuroki, Suntou-gun (JP); Katsuyuki Nonaka, Mishima (JP); Koji Abe, Numazu (JP); Toshihiko Katakura, Susono (JP); Tsuneyoshi Tominaga, Suntou-gun (JP); Sara Yoshida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/089,197

(22) Filed: Apr. 1, 2016

(65) Prior Publication Data

US 2016/0299446 A1 Oct. 13, 2016

(30) Foreign Application Priority Data

Apr. 8, 2015 (JP) ..... 2015-079250

(51) Int. Cl.
*G03G 9/08* (2006.01)
*G03G 9/097* (2006.01)

(52) U.S. Cl.
CPC ..... *G03G 9/0825* (2013.01); *G03G 9/0819* (2013.01); *G03G 9/09725* (2013.01)

(58) Field of Classification Search
CPC ..... G03G 9/0825; G03G 9/09725
USPC ..... 430/108.3, 111.4
See application file for complete search history.

(56) References Cited

U.S. PATENT DOCUMENTS

| | | | |
|---|---|---|---|
| 4,952,476 | A | 8/1990 | Sakashita et al. |
| 4,985,327 | A | 1/1991 | Sakashita et al. |
| 5,014,089 | A | 5/1991 | Sakashita et al. |
| 5,202,213 | A | 4/1993 | Nakahara et al. |
| 5,532,101 | A | 7/1996 | Nozawa et al. |
| 5,534,982 | A | 7/1996 | Sakaizawa et al. |
| 5,731,122 | A | 3/1998 | Yoshida et al. |

(Continued)

FOREIGN PATENT DOCUMENTS

| | | |
|---|---|---|
| JP | H03-089361 | 4/1991 |
| JP | H09-179341 | 7/1997 |

(Continued)

OTHER PUBLICATIONS

U.S. Appl. No. 15/089,218, filed Apr. 1, 2016, Akane Masumoto.

*Primary Examiner* — Mark A Chapman
(74) *Attorney, Agent, or Firm* — Fitzpatrick, Cella, Harper & Scinto

(57) ABSTRACT

Provided is a toner, including toner particle having surface layer, in which: the surface layer includes organosilicon polymer which has a partial structure represented by formula (1); in $^{29}$Si-NMR measurement of tetrahydrofuran-insoluble matter of toner particle, a ratio of a peak area for the partial structure represented by formula (1) to a total peak area for the organosilicon polymer is 5.0% or more; in X-ray photoelectron spectroscopic analysis of a surface of toner particle, a ratio of a density of a silicon atom dSi in the surface of toner particle is 1.0 to 28.6 atom %; and in a roughness curve of toner particle measured by using a scanning probe microscope: an arithmetic average roughness Ra is 10 to 300 nm; σRa/Ra is 0.60 or less; an average length RSm of a roughness curve element is 20 to 500 nm; and σRSm/RSm is 0.60 or less.

6 Claims, 3 Drawing Sheets

(56) References Cited

U.S. PATENT DOCUMENTS

| | | | |
|---|---|---|---|
| 5,774,771 | A | 6/1998 | Kukimoto et al. |
| 5,915,150 | A | 6/1999 | Kukimoto et al. |
| 5,948,584 | A | 9/1999 | Hashimoto et al. |
| 5,998,080 | A | 12/1999 | Ohno et al. |
| 6,214,509 | B1 | 4/2001 | Kasuya et al. |
| 6,300,024 | B1 | 10/2001 | Yusa et al. |
| 6,337,169 | B1 | 1/2002 | Hashimoto et al. |
| 6,458,502 | B1 | 10/2002 | Nakamura et al. |
| 6,500,593 | B2 | 12/2002 | Abe et al. |
| 6,555,282 | B2 | 4/2003 | Okuno et al. |
| 6,569,589 | B2 | 5/2003 | Inaba et al. |
| 6,696,211 | B2 | 2/2004 | Yoshida et al. |
| 6,806,016 | B2 | 10/2004 | Ohno et al. |
| 7,014,969 | B2 | 3/2006 | Yachi et al. |
| 7,300,737 | B2 | 11/2007 | Ayaki et al. |
| 7,459,253 | B2 | 12/2008 | Abe et al. |
| 7,704,661 | B2 | 4/2010 | Ikeda et al. |
| 8,053,156 | B2 | 11/2011 | Abe et al. |
| 8,084,178 | B2 | 12/2011 | Tosaka et al. |
| 8,247,147 | B2 | 8/2012 | Abe et al. |
| 8,367,289 | B2 | 2/2013 | Isono et al. |
| 8,372,573 | B2 | 2/2013 | Ayaki et al. |
| 8,383,313 | B2 | 2/2013 | Ayaki et al. |
| 8,440,382 | B2 | 5/2013 | Isono et al. |
| 8,497,054 | B2 | 7/2013 | Sugiyama et al. |
| 8,551,680 | B2 | 10/2013 | Ayaki et al. |
| 8,652,737 | B2 | 2/2014 | Handa et al. |
| 8,778,581 | B2 | 7/2014 | Nonaka et al. |
| 8,822,120 | B2 | 9/2014 | Abe et al. |
| 8,828,639 | B2 | 9/2014 | Kamikura et al. |
| 2001/0018158 | A1 | 8/2001 | Yoshida et al. |
| 2015/0099220 | A1 | 4/2015 | Abe et al. |
| 2015/0099222 | A1 | 4/2015 | Terui et al. |
| 2015/0099224 | A1 | 4/2015 | Abe et al. |
| 2015/0248071 | A1 | 9/2015 | Katsura et al. |
| 2015/0248072 | A1 | 9/2015 | Katsuta et al. |
| 2015/0277251 | A1 | 10/2015 | Tominaga et al. |
| 2015/0286157 | A1 | 10/2015 | Masumoto et al. |
| 2015/0331344 | A1 | 11/2015 | Tominaga et al. |

FOREIGN PATENT DOCUMENTS

| | | |
|---|---|---|
| JP | 2002-108001 | 4/2002 |
| JP | 2004-085850 | 3/2004 |

TONER

BACKGROUND OF THE INVENTION

Field of the Invention

The present invention relates to a toner for developing an electrostatic image to be used in image forming methods such as electrophotography and electrostatic printing.

Description of the Related Art

As an electrophotographic apparatus using a toner, there are given a laser printer and a copying machine. In recent years, colorization has advanced rapidly, and hence there is a demand for further increase in image quality.

As one of the problems of the electrophotographic apparatus using a toner, first, there is given fogging. In a development process, a toner is developed also in a non-image portion, and a portion in which an image is not intended to be formed is colored. Such an image defect is called fogging.

It is considered to be very difficult to completely eliminate the generation of fogging, that is, to reduce the amount of a toner that is developed in the non-image portion to zero. Meanwhile, it is possible to reduce fogging to an invisible degree. Therefore, hitherto, there have been various proposals regarding means for suppressing fogging. Those technologies basically involve reducing fogging to an invisible degree. In particular, there is given a procedure involving controlling the charge quantity of a toner.

The main cause for the development of a toner in the non-image portion is that particles of the toner contain a particle having an insufficient charge quantity and a particle charged to opposite polarity. The toner having an insufficient charge quantity is slow to react to a back contrast and is transferred to the non-image portion stochastically or due to the action of adhesive force other than electrostatic force. The back contrast refers to a potential difference that is formed between the potential of a toner bearing member and the potential of an electrostatic latent image-bearing member (photosensitive member) in the non-image portion so as to prevent a toner from being developed in the non-image portion to the extent possible. Further, the toner charged to opposite polarity is actively developed in the non-image portion. In order to achieve a toner having those inconvenient particles suppressed to the extent possible, various technologies regarding a toner have been proposed.

As a method of controlling the charge quantity of a toner, there is given a method involving causing an external additive, such as silica fine particles, to adhere to the surface of a toner particle to ensure flowability, thereby uniformizing charging. However, in the case where an image is printed on a large number of sheets, the external additive is embedded or detached, and hence the method still remains susceptible to improvement in terms of fogging. As an improving method therefor, a method has been considered, which involves uniformly covering the surface of a toner particle with a silicon compound.

In Japanese Patent Application Laid-Open No. H03-089361, as the method involving covering the surface of a toner particle with a silicon compound, there is a disclosure of a method of producing a polymerized toner involving adding a silane coupling agent to a reaction system.

Further, in Japanese Patent Application Laid-Open No. H09-179341, there is a disclosure of a polymerized toner having on the surface thereof a coating film of a reaction product of a radical reactive organosilane compound.

Further, as another problem of the electrophotographic apparatus using a toner, there is given improvement of transferability. When a toner image formed on a photosensitive member is transferred onto a transfer material by a transfer unit, there is a case where a transfer residual toner remains on the photosensitive member. In this case, it is necessary to clean the photosensitive member by a cleaning device to recover the transfer residual toner into a waste toner container. However, due to the presence of the cleaning device and the waste toner container, the apparatus is increased in size, which becomes an obstacle for downsizing the apparatus. Further, in a cleaner-less system, it is also necessary to satisfy both a sufficient cleaning property and sufficient transferability for a long period of time, and hence it is considered necessary to remarkably highly control the surface shape of the toner particle.

Further, when a toner is transferred from the photosensitive member onto the transfer material, the amount of a toner that remains on the photosensitive member without being transferred onto the transfer member, that is, the transfer residual toner changes depending on the transfer current. In general, there is an optimum range of the transfer current in which the amount of the transfer residual toner becomes minimum. In the case where the transfer current is lower than the optimum current range, a transfer electric field is small relative to attraction force between the toner and the photosensitive member, and hence the toner does not move to increase the amount of the transfer residual toner.

Meanwhile, in the case where the transfer current is larger than the optimum current range, discharge occurs in a toner layer to rather decrease the transfer electric field, and hence the transfer residual toner is increased. Thus, it is desired that the transfer current be set to the lowest within the optimum current range.

However, the optimum current range changes also depending on the charge quantity of a toner. In particular, in the case where printing is not performed for a long period of time in a high-humidity environment, a reduction in charge quantity and a change in attraction force between the toner and the photosensitive member are liable to occur, and hence the optimum range of the transfer current is liable to change. In order to address this change, there is a method involving determining a transfer current by an environment detection device, such as a temperature and humidity sensor. However, there is a concern that various control devices may be complicated and increased in size. Therefore, there is a demand for a toner having satisfactory transferability within a wide transfer current range without a change in charge quantity even under high temperature and high humidity.

In view of the foregoing, in Japanese Patent Application Laid-Open No. 2002-108001, as a procedure for enhancing transfer efficiency, there is a disclosure of a toner having added thereto a spherical external additive having a large particle diameter.

Further, in Japanese Patent Application Laid-Open No. 2004-085850, there is a disclosure of a toner in which an irregularity period of the surface of a toner obtained by externally adding silica particles to toner particles pulverized by a jet mill is measured by a scanning probe microscope (SPM), and a large irregularity period and a small irregularity period are controlled. There is also a disclosure that, with the foregoing, the flowability of the toner is improved, and a uniform toner brush can be realized, to thereby obtain high image quality excellent in dot reproducibility.

SUMMARY OF THE INVENTION

Investigations made by the inventors of the present invention have found that, in the toner disclosed in Japanese Patent Application Laid-Open No. H03-089361, the precipitation amount of a silane compound onto the surface of the toner is insufficient, and the toner is susceptible to improvement in terms of anti-fogging effect. Further, it has been found that, in the toner disclosed in Japanese Patent Application Laid-Open No. H09-179341, due to the change in chargeability under high temperature and high humidity, the fogging improvement effect is not sufficient, and hence the toner is susceptible to improvement. The following has also been found. The toner disclosed in Japanese Patent Application Laid-Open No. 2002-108001 is an effective technology as a method of enhancing transfer efficiency, but the spherical external additive having a large particle diameter may move to a recess of the surface of the toner due to image output over a long period of time. With this, the spherical external additive having a large particle diameter having moved to the recess does not serve as a spacer, with the result that the effect of enhancing transfer efficiency is not exhibited in some cases. Further, it has been found that, in the toner disclosed in Japanese Patent Application Laid-Open No. 2004-085850, the effect of enhancing transfer efficiency is not sufficiently exhibited due to image output over a long period of time, and hence the toner is susceptible to improvement.

The present invention is directed to providing a toner improved in fogging and transferability as compared to the related art. In fogging, the present invention is directed to providing a toner having dependence on back contrast control suppressed. Further, in transferability, the present invention is directed to providing a toner capable of providing high transfer efficiency by virtue of a reduced amount of a transfer residual toner under wide transfer current conditions through entire endurance even under a severe environment, such as a high-temperature and high-humidity environment.

In order to achieve the above-mentioned objects, the inventors of the present invention have made extensive investigations, and as a result, have found the following toner.

That is, according to one aspect of the present invention, there is provided a toner, including a toner particle including a surface layer, in which:

the surface layer includes an organosilicon polymer;

the organosilicon polymer has a partial structure represented by the following formula (1):

$$R^0—SiO_{3/2} \quad (1)$$

in the formula (1), $R^0$ represents an alkyl group having 1 or more and 6 or less carbon atoms, or a phenyl group;

in a $^{29}$Si-NMR measurement of a tetrahydrofuran-insoluble matter of the toner particle, a ratio of a peak area for the partial structure represented by the formula (1) to a total peak area for the organosilicon polymer is 5.0% or more;

in X-ray photoelectron spectroscopic analysis of a surface of the toner particle, a ratio of a density of a silicon atom dSi to a total density of a density of a carbon atom dC, a density of an oxygen atom dO, and the density of the silicon atom dSi in the surface of the toner particle is 1.0 atom % or more and 28.6 atom % or less; and in a roughness curve of the toner particle measured by using a scanning probe microscope:

an arithmetic average roughness Ra (nm) is 10 nm or more and 300 nm or less;

when a standard deviation of the Ra is σRa (nm), σRa/Ra is 0.60 or less;

an average length RSm (nm) in a roughness curve element is 20 nm or more and 500 nm or less; and when a standard deviation of the RSm is σRSm (nm), σRSm/RSm is 0.60 or less, with a proviso that the Ra and the RSm are defined by JIS B 0601-2001.

Further features of the present invention will become apparent from the following description of exemplary embodiments with reference to the attached drawings.

DESCRIPTION OF THE EMBODIMENTS

Figure 1:
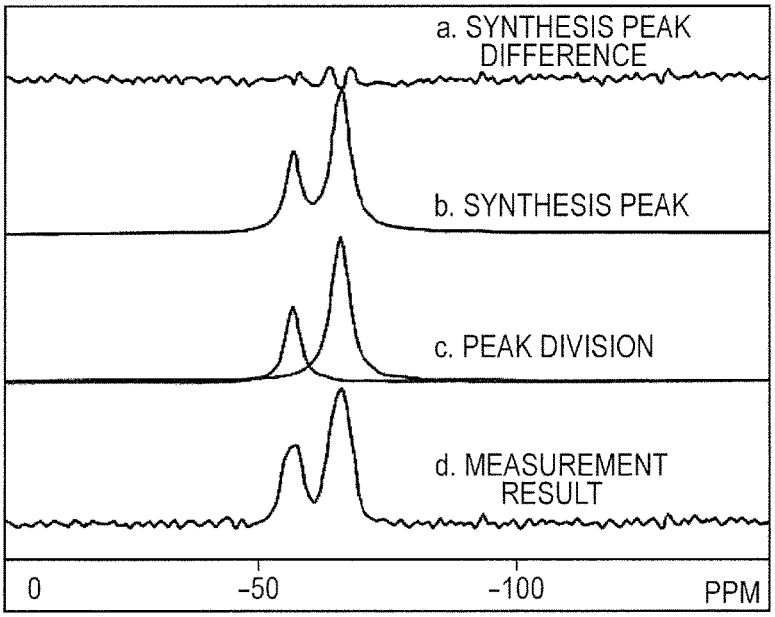
FIG. 1 is a graph for showing an NMR measurement example of an organosilicon compound in the present invention.

Preferred embodiments of the present invention will now be described in detail in accordance with the accompanying drawings.

The present invention is now described in detail.

According to one aspect of the present invention, there is provided a toner including a toner particle having a surface layer containing an organosilicon polymer, and the toner has the following features.

The organosilicon polymer has a partial structure represented by the following formula (1).

$$R^0—SiO_{3/2} \quad (1)$$

($R^0$ represents an alkyl group having 1 or more and 6 or less carbon atoms, or a phenyl group).

Further, in a $^{29}$Si-NMR measurement of a tetrahydrofuran-insoluble matter of the toner particle, a ratio of a peak area for the partial structure represented by the formula (1) to a total peak area for the organosilicon polymer is 5.0% or more.

In X-ray photoelectron spectroscopic analysis of a surface of the toner particle, a ratio of the density of a silicon atom dSi to a total of the density of a carbon atom dC, the density of an oxygen atom dO, and the density of the silicon atom dSi in the surface of the toner particle is 1.0 atomic % or more and 28.6 atomic % or less.

In a roughness curve of the toner particle measured by using a scanning probe microscope, an arithmetic average roughness Ra (nm) is 10 nm or more and 300 nm or less, when a standard deviation of the Ra is defined as σRa (nm), σRa/Ra is 0.60 or less, an average length RSm (nm) in a roughness curve element is 20 nm or more and 500 nm or less, and when a standard deviation of the RSm is defined as σRSm (nm), σRSm/RSm is 0.60 or less (with the proviso that the Ra and the RSm are defined by JIS B 0601-2001).

First, a back contrast is described. As described above, the back contrast refers to a potential difference between a non-image portion of a photosensitive member and a toner bearing member or a developer bearing member. Although depending on the system, the back contrast is substantially set to from about 100 V to about 200 V. Further, the back contrast is a control element important for suppressing fogging, and hence a control mechanism is generally provided, which is configured to detect a usage environment and the number of sheets used and to set the back contrast so that optimum fogging suppression can be exhibited.

When the back contrast is decreased, fogging is rapidly increased. This is because, when the back contrast is decreased, driving force for a toner brought into contact with the photosensitive member to return to the toner bearing member is decreased. Thus, the back contrast of a predetermined value or more is required.

Meanwhile, when the back contrast is increased, fogging is gradually increased in some cases. Depending on the case, fogging may occur rapidly when the back contrast exceeds a certain value. This is because a toner contains a toner charged to opposite polarity.

When various developing components and a toner are degraded, the value range of the back contrast capable of suppressing fogging to such a degree that fogging is not recognized as an image failure is liable to become narrow. For example, it is assumed that there is a system in which fogging is not visually recognized at a back contrast of from 80 V to 300 V in an initial usage period. However, when the degradation of the various components and the toner proceeds due to endurance (long-term use), the following situation occurs. The usable region is from 100 V to 130 V, and when the back contrast reaches a region out of this usable region, the region out of the usable region is recognized as a region in which fogging occurs as an image failure. The optimum value range of the back contrast becomes narrow as a result of the degradation due to endurance (this phenomenon is expressed herein as decrease in fogging latitude). Further, in the case where the degradation proceeds until the back contrast capable of suppressing fogging to such a degree that fogging is not recognized as an image failure cannot be set, it may be determined that the various development components and the toner have reached the end of the lives.

Further, there is also a case where the fogging latitude changes depending on the usage environment. In a low-humidity environment, the charge quantity of a toner becomes broad, and fogging is liable to occur. Therefore, there is a case where the back contrast needs to be set within a narrow range. In a high-humidity environment, there is a case where a toner having a low charge quantity cannot be prevented from being generated, and hence the optimum back contrast is limited.

When a toner capable of suppressing fogging in a wide back contrast region can be provided, it becomes easy to, for example, simplify a developing control device, reduce a toner use amount, and simplify or eliminate a cleaning mechanism. Next, the reason that the toner of the present invention can suppress fogging in a wide back contrast region is discussed.

The toner of the present invention contains an organosilicon polymer having a partial structure represented by $R^0$—$SiO_{3/2}$ (formula (1)) ($R^0$ represents an alkyl group having 1 or more and 6 or less carbon atoms, or a phenyl group) in the surface layer. In the partial structure represented by the formula (1), one of the four atomic valences of a Si atom is bonded to an organic group represented by $R^0$, and the other three atomic valences are bonded to O atoms. The O atoms each form a state in which both two atomic valences thereof are bonded to Si, that is, a siloxane bond (Si—O—Si). When Si atoms and O atoms in the organosilicon polymer as a whole are considered, the organosilicon polymer has three O atoms per two Si atoms, and hence the Si atoms and the O atoms are represented by -$SiO_{3/2}$. That is, the organosilicon polymer has a structure represented by the following formula (2).

Formula (2)

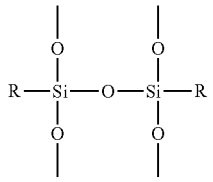

It is considered that the —$SiO_{3/2}$ structure of the organosilicon polymer has properties similar to those of silica ($SiO_2$) formed of a large number of siloxane structures. Thus, it is considered that the toner of the present invention creates a situation similar to that of the case where silica is added. Meanwhile, it is considered that, through incorporation of $R^0$, there is some action different from that of silica.

According to the principle of fogging, when the amount of a toner having a low charge quantity or a toner charged to opposite polarity is small, that is, when a toner charge quantity distribution is sharp during long-term use and in different environments, it is considered that the fogging latitude is widened. In view of the foregoing, a charge quantity distribution of the toner of the present invention on a toner bearing member was measured, but the amount of a toner having a low charge quantity or a toner charged to opposite polarity was not excessively small. Thus, it is considered that there is some reason for exhibition of the effect other than the charge quantity distribution. The inventors of the present invention have made various investigations, and as a result, have assumed that some specific matter is occurring at time of development.

When a toner passes through a developing section where the photosensitive member and the toner bearing member are brought closest to each other, exchange of charge is occurring in the toner. The reason for this is as follows. Even in the case where a toner on the toner bearing member passes through the developing section, and the toner remains on the toner bearing member without being developed, it is observed that the charge quantity changes before and after the passage. In the toner of the present invention, a result suggesting that this change is very small was obtained.

First, the organosilicon polymer having a partial structure represented by $R^0$—$SiO_{3/2}$ exists on the surface of the toner particle. Due to the existence of $R^0$—, the oxygen density is smaller than that of silica, and hence it is considered that the charge density of toner charge is probably smaller than that of a portion of silica.

The reason that fogging is suppressed by suppressing the exchange of charge in the developing section is described. Investigations made by the inventors of the present invention have found that a toner having a charge quantity that changes before and after the passage through the developing section may have a narrow fogging latitude. It is suggested that, in the toner of the present invention, the change in charge quantity before and after the passage through the developing section is small. This suggestion and fogging characteristics are considered together. In the case where the change in toner charge quantity is large at time of passage through the developing section and the fogging latitude is decreased, it is considered that a toner having opposite polarity and a toner having a low charge quantity are generated in the developing section. This is because, when the toner having opposite polarity and the toner having a low charge quantity are not generated even in the case where the toner charge quantity changes in the developing section, it is considered that the fogging latitude does not substantially change. Thus, if a state in which the charge quantity distribution of the toner on the toner bearing member is narrow to some degree, and in which the toner charge quantity does not change in the developing section can be achieved during long-term use, the state of a wide fogging latitude is expected to be maintained. The inventors of the present invention consider that the toner of the present invention has achieved the foregoing.

It is necessary that the toner particle of the present invention contain 5.0% or more of the partial structure represented by the formula (1) with respect to all the silicon atoms contained in the organosilicon polymer. That is, in a $^{29}$Si-NMR measurement of a tetrahydrofuran-insoluble matter of the toner particle, a ratio of a peak area for the partial structure represented by the formula (1) to a total peak area for the organosilicon polymer is 5.0% or more. This means that 5.0% or more of the organosilicon polymer contained in the toner particle corresponds to the peak area for the partial structure represented by —$SiO_{3/2}$. A —$SiO_{3/2}$ skeleton is considered to be an element required for enhancing durability and optimizing charge density, and it is interpreted that 5.0% or more of this structure needs to be incorporated. When the peak area for the partial structure is less than 5.0%, the effect on transferability is not exhibited easily during long-term use.

The —$SiO_{3/2}$ indicates, for example, that three of the four atomic valences of a Si atom are bonded to oxygen atoms, and the oxygen atoms are further bonded to other Si atoms. When one of those is SiOH, the partial structure of silicon thereof is represented by R—$SiO_{2/2}$—OH. This structure is similar to a di-substituted silicone resin typified by dimethyl silicone. It is considered that, when the peak area for the structure of —$SiO_{3/2}$ is less than 5%, a resinous property becomes dominant, and when the peak area for the structure of —$SiO_{3/2}$ is 5% or more, a hard property such as that of silica starts being expressed. That is assumed to be one factor for the satisfactory effect on transferability during long-term use. Meanwhile, it is considered that, in the case where a structure such as that of $SiO_2$ is dominant, the hard property becomes dominant, and there is an effect on transferability during long-term use. However, in this case, it is considered that the density of oxygen is high, and hence a wide fogging latitude is not obtained easily. The ratio of the peak area for the partial structure represented by the formula (1) to the total peak area for the organosilicon polymer is preferably 40.0% or more. It is considered that, when the peak area is 40.0% or more, the structure of the organosilicon polymer is further strengthened, and charge stability is improved by optimizing the oxygen density. The ratio of the peak area for the partial structure represented by the formula (1) to the total peak area for the organosilicon polymer is preferably as close as possible to 100.0%, and the ratio is most preferably approximated to 100.0% by various means.

It is also necessary that, in X-ray photoelectron spectroscopic analysis of a surface of the toner particle of the present invention, the ratio of the density of a silicon atom dSi to the total of the density of a carbon atom dC, the density of an oxygen atom dO, and the density of the silicon atom dSi in the surface of the toner particle be 1.0 atomic % or more and 28.6 atomic % or less. Triboelectric charging occurs on the surface of the toner, and hence the organosilicon compound of the present invention needs to exist on the surface of the toner, which is one of the conditions for exhibiting the effect of the present invention. The density of a silicon atom dSi is more preferably 9.0 atomic % or more. Meanwhile, the density of a silicon atom dSi needs to be 28.6 atomic % or less from the viewpoint of structural stability.

Main atoms of the toner particle that are generally considered are carbon (C) and oxygen (O). In the present invention, in the case where a silicon (Si) atom exists in the surface of the toner particle, there exists a portion in which an O atom is bonded to the Si atom. Then, —$SiO_{3/2}$ exists in an amount defined by the present invention. Thus, it is considered that, when the dSi falls within the above-mentioned range, the organosilicon polymer of the present invention exists in the surface of the toner particle, with the result that the above-mentioned performance is improved.

In a roughness curve of the toner particle of the present invention measured by using a scanning probe microscope, an arithmetic average roughness Ra (nm) defined by JIS B 0601-2001 is 10 nm or more and 300 nm or less, and when a standard deviation of the Ra is defined as σRa (nm), σRa/Ra is 0.60 or less.

The scanning probe microscope (hereinafter referred to as "SPM") includes a probe, a cantilever configured to support the probe, and a displacement measurement system configured to detect a bend of the cantilever. The SPM is configured to detect atomic force (attraction force or repulsive force) between the probe and a sample, to thereby observe the shape of the surface of the sample.

The arithmetic average roughness Ra measured by using the SPM is obtained by three-dimensionally extending a center line average roughness Ra defined by JIS B 0601-2001 so that the center line average roughness Ra can be applied to a measurement surface. The arithmetic average roughness Ra is a value obtained by averaging absolute values of a deviation from a reference surface to a specified surface and is represented by the following expression. This value is an indicator for indicating the roughness of the surface of a particle and enables irregularity information on the surface of the toner particle to be obtained on a nanometer scale. Further, there is a feature in that the influence of one scar on a measured value is very small, and hence stable results are obtained.

$$Ra = \frac{1}{S_0}\int_{YB}^{YT}\int_{XL}^{XR}|F(X, Y) - Z_0|\,dX\,dY.$$

F(X,Y): surface indicating entire measurement data $S_0$: area when specified surface is assumed to be ideally flat $Z_0$: average value of Z data in specified surface In the present invention, the specified surface refers to a square measurement area measuring 1 μm per side.

When the arithmetic average roughness Ra measured by using the SPM is 10 nm or more and 300 nm or less, a protrusion having an appropriate size is formed on the surface of the toner particle, which can sufficiently reduce physical adhesive force of the toner with respect to the photosensitive member even under a state in which an external additive and the like are not added. With this, a toner having satisfactory transfer efficiency in a wide transfer current region and generating little transfer residual toner can be provided.

Further, when the protrusion is formed on the surface of the surface layer containing the organosilicon polymer, the protrusion strongly adheres to the surface of the toner. Therefore, a toner in which the protrusion is not peeled or buried easily even by image output over a long period of time can be provided. With this, initial transferability and performance of fogging can be maintained even after endurance.

When the Ra is less than 10 nm, the height of the protrusion formed on the surface of the toner particle is excessively small, and hence the protrusion cannot exhibit a sufficient spacer effect. Thus, the physical adhesive force of the toner with respect to the photosensitive member is not decreased easily, and the transfer efficiency of the toner is liable to be decreased. Further, the toner tends to be degraded during long-term use. Meanwhile, when the Ra is more than 300 nm, the protrusion formed on the surface of the toner particle receives larger resistance when stress, such as rubbing or pressure, is applied, and hence the protrusion is liable to be detached from the toner particle. Therefore, in the case where image output is performed over a long period of time, the chargeability of the toner is liable to be decreased, and fogging and the like are liable to occur due to a charging failure.

The value of the Ra is preferably 20 nm or more and 200 nm or less, more preferably 40 nm or more and 100 nm or less.

The formation of the protrusion having the Ra within the above-mentioned range can be controlled by adding a particle having a relatively large particle diameter, such as silica particles, together with the organosilicon polymer during production of the toner particle. Further, even in the case of producing the toner particle through use of only the organosilicon polymer, the protrusion can be formed by controlling production conditions, such as a pH, during production.

Further, the value of the Ra can be controlled based on a particle diameter of the particle having a large particle diameter and the like.

Toner particle of the present invention has σRa/Ra of 0.60 or less when a standard deviation of the Ra measured by using the SPM is defined as σRa. The σRa/Ra represents a variation in height of the protrusion on the surface of the toner particle. As the value of the σRa/Ra is smaller, the height of the protrusion is less varied. When the σRa/Ra is 0.60 or less, the variation in height of the protrusion formed on the surface of the toner particle can be decreased. Therefore, a distribution of physical adhesive force of the toner is decreased, and physical adhesive force of the toner with respect to the photosensitive member becomes uniform. Therefore, the transfer efficiency becomes more satisfactory in a wide transfer current region.

When the σRa/Ra is more than 0.60, the variation in height of the protrusion on the surface of the toner particle is increased. Therefore, physical adhesive force of a portion that is brought into contact with the photosensitive member is liable to be varied for the toner, and the transfer efficiency is liable to be decreased.

The σRa/Ra can be controlled by adjusting a coefficient of variation in a volume particle size distribution of particles each having a large particle diameter to be added during production of the toner particle. Further, even in the case of producing the toner particle through use of only the organosilicon polymer, the σRa/Ra can be controlled by controlling, for example, a pH and a polymerization temperature during production.

In the roughness curve of the toner particle of the present invention, an average length RSm (nm) of a roughness curve element of the toner particle defined by JIS B 0601-2001 is 20 nm or more and 500 nm or less, and when a standard deviation of the RSm is defined as σRSm (nm), σRSm/RSm is 0.60 or less.

The average length RSm of the roughness curve element measured by using the SPM is defined by JIS B 0601-2001 and is a value obtained by taking out only a reference length from a roughness curve in a direction of an average line thereof and averaging lengths of irregularity portions in one period included in a roughness curve at a certain reference length 1. The average length RSm is represented by the following expression. The reference length in the present invention is 1 μm.

$$RSm = \frac{1}{n}\sum_{i=1}^{n} RSm_i$$

$RSm_i$: length of each irregularity in one period included in roughness curve n: total number of all irregularity portions included in reference length (l)

Through measurement of the RSm of the toner particle, information on an interval of protrusions formed on the surface of the toner particle can be obtained. Further, information on a variation degree of the intervals of the protrusions can be obtained based on a ratio between the standard deviation σRSm and the RSm.

When the average length RSm of the roughness curve element is 20 nm or more and 500 nm or less, protrusions at an appropriate density (interval) are formed on the surface of the toner particle, and the physical adhesive force of the toner particle with respect to the photosensitive member is stabilized. Further, a toner can be provided in which the protrusion easily expresses the spacer effect when stress, such as rubbing or pressure, is applied and the degradation of the toner is suppressed. With this, a toner that maintains a wide transfer latitude during long-term use can be provided. Further, a toner in which the protrusion is not peeled or buried easily even by image output over a long period of time can be provided.

When the RSm is less than 20 nm, the density of the protrusions is excessively large, and hence electrostatic adhesive force of the toner is liable to increase. As a result, the flowability of the toner is liable to be decreased, and the transfer efficiency may be decreased. Further, when the RSm is more than 500 nm, the density of the protrusions is excessively small, and hence the physical adhesive force of the toner particle with respect to the photosensitive member may be increased particularly in a low-temperature and low-humidity environment. Therefore, there may be a negative effect that a transfer residual toner is increased.

The RSm can be controlled within the above-mentioned range by adjusting the addition amount of particles to be added together with the organosilicon polymer during production of the toner particle. Further, even in the case of producing the toner particle through use of only the organosilicon polymer, the RSm can be controlled by controlling production conditions, such as a pH, during production.

Further, when the σRSm/RSm is 0.60 or less, the interval of the protrusions on the surface of the toner particle become uniform. As a result, the variation in physical adhesive force of a toner surface that is brought into contact with the photosensitive member is decreased, and the transferability of the toner is further improved.

When the σRSm/RSm is more than 0.60, the interval of the protrusions formed on the surface of the toner particle becomes non-uniform. Therefore, the variation in non-electrostatic adhesive force of a toner surface that is brought into contact with the photosensitive member is increased, and a transfer residual toner may be increased particularly in a low-temperature and low-humidity environment. Further, a region having the protrusions at a small density (interval) exists, and hence the protrusions do not easily express the spacer effect when stress, such as rubbing or pressure, is applied, and the degradation of the toner may be liable to occur.

The σRSm/RSm can be controlled within the above-mentioned range by adjusting the addition timing of particles to be added together with the organosilicon polymer, the production temperature of the toner particle, and the like during production of the toner particle.

In the present invention, as means for controlling the arithmetic average roughness Ra to 10 nm or more and 300 nm or less, a procedure involving internally adding particles each having a relatively large particle diameter to the toner particle together with the organosilicon polymer, thereby causing the particles each having a relatively large particle diameter to exist in the surface layer is preferably used.

There is no particular limitation on the particles to be added, but there are given the following materials. First, as inorganic fine particles, for example, there are given silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, colcothar, antimony trioxide, magnesium oxide, zirconium oxide, barium sulfate, barium carbonate, calcium carbonate, silicon carbide, and silicon nitride. In order to suppress decrease in flow characteristics and charging characteristics of the toner under high humidity, it is preferred that the hydrophobicity of the inorganic fine particles be increased through use of a surface treatment agent. Examples of the preferred surface treatment agent may include a silane coupling agent, a silylation agent, a silane coupling agent having an alkyl fluoride group, an organotitanate-based coupling agent, an aluminum-based coupling agent, silicone oil, and modified silicone oil.

Further, a metal salt of stearic acid or any other fatty acid, such as zinc stearate or calcium stearate, or polymer fine particles produced by soap-free emulsion polymerization or the like, such as polymethyl methacrylate fine particles or polystyrene fine particles, are also preferably used.

It is preferred that the above-mentioned particles have a relatively large particle diameter, specifically a volume average particle diameter of about 20 nm or more and about 700 nm or less. Further, it is preferred that the particle size distribution of the particles be sharp, and the coefficient of variation in a volume particle size distribution of the particles be 30% or less.

Of the above-mentioned particles, silica particles are more preferably used from the viewpoint of compatibility with the organosilicon polymer. Through use of the silica particles, a protrusion that adheres more strongly to the surface layer containing the organosilicon polymer is formed.

As a method of producing silica particles, for example, there are given the following methods.

A combustion method of obtaining silica particles by burning a silane compound (that is, a production method for fumed silica).

A deflagration method of obtaining silica particles by burning metal silicon powder in an explosive manner.

A wet method of obtaining silica particles through a neutralization reaction between sodium silicate and a mineral acid (of those, a method involving synthesizing silica particles under alkali conditions is referred to as sedimentation method, and a method involving synthesizing silica particles under acid conditions is referred to as gel method.)

A sol-gel method of obtaining silica particles through hydrolysis of an alkoxysilane, such as hydrocarbyloxysilane (so-called Stoeber method).

Of those, a sol-gel method capable of obtaining a relatively sharp particle size distribution of a silica particle is preferred.

In order to obtain a sharp particle size distribution of the silica particles and exhibit a more effective spacer effect, it is preferred that the silica particles be subjected to shredding treatment.

The particles to be added for forming a protrusion may be subjected to hydrophobic treatment.

As a method of subjecting the particles to hydrophobic treatment, various methods can be used. Examples thereof include a method involving treating the particles with a hydrophobizing agent in a dry process, and a method involving treating the particles with a hydrophobizing agent in a wet process.

Of those, a dry hydrophobic treatment method is preferred from the viewpoint that excellent flowability can be imparted to the toner while the aggregation of the particles is suppressed. Examples of the dry hydrophobic treatment method include a method involving spraying a hydrophobizing agent to the particles with stirring of the particles, to thereby treat the particles, and a method involving introducing vapor of a hydrophobizing agent into silica particles on a fluidized bed or the particles under stirring.

Examples of the hydrophobizing agent for the particles include: chlorosilanes, such as methyltrichlorosilane, dimethyldichlorosilane, trimethylchlorosilane, phenyltrichlorosilane, diphenyldichlorosilane, t-butyldimethylchlorosilane, and vinyltrichlorosilane; alcoxysilanes, such as tetramethoxysilane, methyltrimethoxysilane, dimethyldimethoxysilane, phenyltrimethoxysilane, diphenyldimethoxysilane, o-methylphenyltrimethoxysilane, p-methylphenyltrimethoxysilane, n-butyltrimethoxysilane, i-butyltrimethoxysilane, hexyltrimethoxysilane, octyltrimethoxysilane, decyltrimethoxysilane, dodecyltrimethoxysilane, tetraethoxysilane, methyltriethoxysilane, dimethyldiethoxysilane, phenyltriethoxysilane, diphenyldiethoxysilane, i-butyltriethoxysilane, decyltriethoxysilane, vinyltriethoxysilane, γ-methacryloxypropyltrimethoxysilane, γ-glycidoxypropyltrimethoxysilane, γ-glycidoxypropylmethyldimethoxysilane, γ-mercaptopropyltrimethoxysilane, γ-chloropropyltrimethoxysilane, γ-aminopropyltrimethoxysilane, γ-aminopropyltriethoxysilane, γ-(2-aminoethyl)aminopropyltrimethoxysilane, and γ-(2-aminoethyl) aminopropylmethyldimethoxysilane; silazanes, such as hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane, and dimethyltetravinyldisilazane; silicone oils, such as dimethyl silicone oil, methyl hydrogen silicone oil, methyl phenyl silicone oil, alkyl-modified silicone oil, chloroalkyl-modified silicone oil, chlorophenyl-modified silicone oil, fatty acid-modified silicone oil, polyether-modified silicone oil, alkoxy-modified silicone oil, carbinol-modified silicone oil, amino-modified silicone oil, fluorine-modified silicone oil, and terminal-reactive silicone oil; siloxanes, such as hexamethyl cyclotrisiloxane, octamethyl cyclotetrasiloxane, decamethyl cyclopentasiloxane, hexamethyl disiloxane, and octamethyl trisiloxane; long-chain fatty acids, such as undecylic acid, lauric acid, tridecylic acid, dodecylic acid, myristic acid, palmitic acid, pentadecylic acid, stearic acid, heptadecylic acid, arachic acid, montanic acid, oleic acid, linoleic acid, and arachidonic acid; and salts of the fatty acids and metals, such as zinc, iron, magnesium, aluminum, calcium, sodium, and lithium. Of those hydrophobizing agents, alkoxysilanes, silazans, and silicone oils (in particular straight silicone oil) are preferred because the hydrophobic treatment for the particle is easy to perform. One kind of those hydrophobizing agents may be used alone, or two or more kinds thereof may be used in combination.

As a method of incorporating the above-mentioned particles into the toner particle, for example, in a suspension polymerization method or a dissolution suspension method, there are given a method involving adding the particles in a powder state and a method involving adding the particles dispersed in a liquid. Of those, in particular, a method involving adding the particles dispersed in a solvent of an organosilicon compound is preferred. Further, the particles may be added before the particles of a toner composition (polymerizable monomer composition or resin solution) is formed in an aqueous medium or after the polymerization of the toner composition proceeds to some degree. From the viewpoint of efficiently forming irregularities derived from the particles on the surface of the toner, a method involving adding the particles after the polymerization of the toner composition proceeds to some degree is more preferred.

It is more preferred that, in the following RSm1 and RSm2 of the toner of the present invention, RSm2/RSm1 be 1.20 or less.

The RSm1 represents an average length of a roughness curve element defined by JIS B 0601-2001 of the toner. The RSm2 represents an average length of a roughness curve element defined by JIS B 0601-2001 of a treated-toner obtained by subjecting the above-mentioned toner to centrifugation in a sucrose solution.

In general, various fine particles such as an external additive added to the surface of toner particle partially contain particles each having small adhesive force with respect to the surface of a toner. Such particles each having small adhesive force is liberated from the surface of the toner during long-term use, which may cause decrease in transferability of the toner. Therefore, it is preferred that the particles adhering to the surface of the toner maintain an initial adhesion state to the extent possible, and the inventors of the present invention have found that the RSm2/RSm1 is an indicator capable of grasping the ease of change in the adhesion state.

That is, the RSm1 is an indicator for indicating an average length of a roughness curve element formed on the surface of a toner immediately after the production of the toner, and the RSm2 is an indicator for indicating an average length of a roughness curve element on the surface of a treated-toner after the particle having small adhesive force with respect to the surface of the toner has been removed through application of mechanical stress to the toner. The RSm2 is an indicator capable of indicating a state of the surface of the toner in a simulated manner after long-term use during which the toner has received stress, such as rubbing or pressure.

In this connection, as a method of obtaining a toner obtained by subjecting a toner to centrifugation in a sucrose solution, specifically, there is given the following method.

160 g of sucrose (manufactured by Kishida Chemical Co., Ltd.) is added to 100 mL of ion-exchanged water and dissolved through use of a water bath, to thereby prepare a sucrose concentrated solution. 31 g of the sucrose concentrated solution and 6 mL of Contaminon N (10 mass % aqueous solution of a neutral detergent having a pH of 7 for cleaning a precision measuring instrument containing a nonionic surfactant, an anionic surfactant, and an organic builder, manufactured by Wako Pure Chemical Industries, Ltd.) are put into a centrifugation tube, to thereby produce a dispersion liquid. 1.0 g of a toner is added to the dispersion liquid, and a toner lump is broken with a spatula or the like.

The centrifugation tube is shaken by a shaker at 350 strokes per min (spm) for 20 minutes. After shaking, the solution is transferred into a glass tube for a swing rotor (50 mL) and subjected to centrifugation by a centrifugal separator at 3,500 rpm for 30 minutes. With this operation, the solution is separated into toner particle and external additives detached from the toner particle. It is confirmed visually that the toner and the aqueous solution have been sufficiently separated, and the toner separated into an uppermost layer is collected with a spatula or the like. The collected toner is filtered by a vacuum filter and then dried by a drier for 1 hour or more, to thereby obtain a treated-toner. This operation is performed a plurality of times to obtain a required amount.

In general, the value of RSm2 under a state in which part of particles on the surface of a toner are removed is larger than RSm1. As RSm2/RSm1 is larger, the particles such as external additives on the surface of the toner is liable to be detached, and the transferability of the toner is liable to change easily.

In the toner of the present invention, the RSm2/RSm1 is preferably 1.20 or less, more preferably 1.10 or less.

When the RSm2/RSm1 is 1.20 or less, the ratio of particles having small adhesive force in particles on the surface of the toner is small, and hence a toner in which a change in transferability is further smaller during long-term use can be provided. Further, when the RSm2/RSm1 is 1.10 or less, the ratio of particles having small adhesive force in particles on the surface of the toner can be further decreased to 10% or less, and hence a toner having excellent durability even in a wide range of environments and severe usage, as well as a small change in transferability, can be obtained.

The RSm2/RSm1 can be controlled within the above-mentioned range by adjusting a production method for toner particle during formation of the organosilicon polymer, hydrolysis during formation of the organosilicon polymer, and the reaction temperature, reaction time, reaction solvent, and pH during polymerization. Further, the RSm2/RSm1 can also be controlled by adjusting the content of the organosilicon polymer. Further, the RSm2/RSm1 can also be controlled by adjusting, for example, addition timing of the organosilicon polymer and fine particles for forming a protrusion during a step of forming a protrusion on the surface of the toner particle.

In the present invention, it is more preferred that $R^0$ in the formula (1), which is a particle structure of the organosilicon polymer, represent a methyl group or an ethyl group. With this, the fogging latitude enhancement effect in the present invention can be exhibited significantly. The inventors of the present invention assume that the density of oxygen is in a state preferred for exhibiting the effect.

It is preferred that the organosilicon polymer to be used in the present invention be a polymer of an organosilicon compound having a structure represented by the following formula (3).

Formula (3)

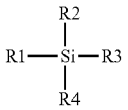

(In the formula (3), R1 represents a saturated hydrocarbon group or an aryl group, and R2, R3, and R4 each independently represent a halogen atom, a hydroxy group, an acetoxy group, or an alkoxy group.)

Through hydrolysis, addition polymerization, and condensation polymerization of the R2, R3, and R4, a —Si—O—Si— structure is obtained easily, and conditions can be controlled easily. It is preferred that the R2, R3, and R4 each represent an alkoxy group from the viewpoint of controllability of polymerization conditions and ease of formation of a siloxane structure. From the viewpoints of a precipitation property and a covering property of the organosilicon polymer with respect to the surface of the toner particle, it is more preferred that the R2, R3, and R4 each represent a methoxy group or an ethoxy group. It should be noted that the hydrolysis, addition polymerization, and condensation polymerization of the R2 to R4 can be controlled based on a reaction temperature, a reaction time, a reaction solvent, and pH. Further, as the saturated hydrocarbon group of the R1, there is given an alkyl group having 1 to 6 carbon atoms. The saturated hydrocarbon group is more preferably a methyl group, an ethyl group, or a butyl group, still more preferably a methyl group or an ethyl group. As the aryl group of the R1, a phenyl group is preferred. For example, when an organosilicon compound in which the R1 represents a methyl group or an ethyl group is used, $R^0$ in the formula (1) can be a methyl group or an ethyl group.

Specific examples of the organosilicon compound for producing the organosilicon polymer in the present invention include methyltrimethoxysilane, methyltriethoxysilane, methyltrichlorosilane, ethyltrimethoxysilane, ethyltriethoxysilane, ethyltrichlorosilane, ethyltriacetoxysilane, propyltrimethoxysilane, propyltriethoxysilane, propyltrichlorosilane, butyltrimethoxysilane, butyltriethoxysilane, butyltrichlorosilane, butylmethoxydichlorosilane, butylethoxydichlorosilane, hexyltrimethoxysilane, hexyltriethoxysilane, phenyltrimethoxysilane, and phenyltriethoxysilane. One kind of those organosilicon compounds may be used alone, or two or more kinds thereof may be used in combination.

In general, it is known that, in a sol-gel reaction, the bonding state of a siloxane bond to be generated varies depending on the acidity of a reaction medium. Specifically, in the case where the medium is acidic, a hydrogen ion is electrophilically added to oxygen of one reaction group (for example, an alkoxy group (—OR group)). Then, an oxygen atom in a water molecule is coordinated to a silicon atom to become a hydrosilyl group through a substitution reaction. In the case where water exists sufficiently, one $H^+$ attacks one oxygen of the reaction group (for example, an alkoxy group (—OR group)). Therefore, when the content of $H^+$ in the medium is small, the substitution reaction to a hydroxy group becomes slow. Thus, a polycondensation reaction occurs before all the reaction groups bonded to silane are subjected to hydrolysis, with the result that a one-dimensional linear polymer or a two-dimensional polymer is generated relatively easily.

Meanwhile, in the case where the medium is alkaline, a hydroxide ion is added to silicon to form a five-coordinated intermediate. Therefore, all the reaction groups (for example, alkoxy groups (—OR groups)) are easily detached to be easily substituted by a silanol group. In particular, in the case of using a silicon compound having three or more reaction groups in the same silane, hydrolysis and polycondensation occur three-dimensionally, to thereby form an organosilicon polymer containing a large number of three-dimensional crosslinking bonds. Further, the reaction is finished within a short period of time.

Thus, in order to form an organosilicon polymer, it is preferred that the sol-gel reaction proceed under an alkaline state. In the case of producing an organosilicon polymer in an aqueous medium, specifically, it is preferred that the reaction proceed under conditions of a pH of 8.0 or more, a reaction temperature of 90° C. or more, and a reaction time of 5 hours or more. With this, an organosilicon polymer having higher strength and being excellent in durability can be formed.

Next, a method of producing the toner particle of the present invention is described. As the other additives, the following resins can be used within a range not influencing the effects of the present invention: homopolymers of styrene and substituted styrenes, such as polystyrene and polyvinyltoluene; styrene-based copolymers, such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleate copolymer; and polymethyl methacrylate, polybutyl methacrylate, polyvinyl acetate, polyethylene, polypropylene, polyvinyl butyral, a silicone resin, a polyester resin, a polyamide resin, an epoxy resin, a polyacrylic resin, rosin, modified rosin, a terpene resin, a phenol resin, an aliphatic or alicyclic hydrocarbon resin, and an aromatic petroleum resin. One kind of those resins may be used alone, or two or more kinds thereof may be used as a mixture.

Now, a specific method of producing the toner of the present invention is described, but the present invention is not limited thereto.

As a first production method, there is provided a method involving suspending a polymerizable monomer composition containing a polymerizable monomer, a colorant, and an organosilicon compound in an aqueous medium, granulating the suspension, and polymerizing the polymerizable monomer, to thereby obtain the toner particle of the present invention. In the toner particle, the organosilicon compound is polymerized in the vicinity of the surface of the toner in a state of being precipitated on the surface of the toner, and hence a surface layer containing the organosilicon polymer can be formed on the surface of the toner particle. Further, there is an advantage in that the organosilicon compound is uniformly precipitated easily. Such suspension polymerization method is the most preferred production method from the viewpoint of uniformity of the surface layer containing the organosilicon compound on the surface of the toner particle.

As a second production method, there is provided a method involving obtaining a toner base material and then forming a surface layer of an organosilicon polymer in an aqueous medium. The toner base material may be obtained by melting and kneading a binder resin and a colorant and pulverizing the resultant or by aggregating binder resin particles and colorant particles in an aqueous medium and associating the aggregate. Alternatively, the toner base material may be obtained by suspending, granulating, and polymerizing an organic phase dispersion liquid, which is produced by dissolving a binder resin, an organosilicon compound, and a colorant in an organic solvent, in an aqueous medium and thereafter removing the organic solvent.

As a third production method, there is provided a method involving suspending, granulating, and polymerizing an organic phase dispersion liquid, which is produced by dissolving a binder resin, an organosilicon compound, and a colorant in an organic solvent, in an aqueous medium and thereafter removing the organic solvent, to thereby obtain the toner particle. Also in this method, the organosilicon compound is polymerized in the vicinity of the surface of the toner particle in a state of being precipitated on the surface of the toner.

As the preferred aqueous medium in the present invention, there are given: water, alcohols, such as methanol, ethanol, and propanol, and mixed solvents thereof.

Preferred examples of the polymerizable monomer in the suspension polymerization method may include the following vinyl-based polymerizable monomers: styrene; styrene derivatives, such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstylene, p-n-nonylstyrene, p-n-decylstyrene, p-n-dodecylstyrene, p-methoxystyrene, and p-phenylstyrene; acrylic polymerizable monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxy ethyl acrylate; methacrylic polymerizable monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; methylene aliphatic monocarboxylic acid esters; vinyl esters, such as vinyl acetate, vinyl propionate, vinyl benzoate, vinyl butyrate, vinyl benzoate, and vinyl formate; vinyl ethers, such as vinyl methyl ether, vinyl ethyl ether, and vinyl isobutyl ether; and vinyl methyl ketone, vinyl hexyl ketone, and vinyl isopropyl ketone.

In addition, as a polymerization initiator to be used in the polymerization, the following are given: azo-based or diazo-based polymerization initiators, such as 2,2'-azobis-(2,4-divaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators, such as benzoyl peroxide, methyl ethyl ketone peroxide, diisopropyl oxycarbonate, cumene hydroperoxide, 2,4-dichlorobenzoyl peroxide, and lauroyl peroxide. Those polymerization initiators are preferably added in an amount of from 0.5 mass % to 30.0 mass % with respect to the polymerizable monomer. One kind of those polymerization initiators may be used alone, or two or more kinds thereof may be used in combination.

Further, in order to control the molecular weight of the binder resin forming the toner particle, a chain transfer agent may be added in the polymerization. The addition amount thereof is preferably from 0.001 mass % to 15.0 mass % of the polymerizable monomer.

Meanwhile, in order to control the molecular weight of the binder resin forming the toner particle, a crosslinking agent may be added in the polymerization. As a crosslinkable monomer, there are given: divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycols #200, #400, and #600, dipropylene glycol diacrylate, polypropylene glycol diacrylate, a polyester-type diacrylate (MANDA, manufactured by Nippon Kayaku Co., Ltd.), and ones obtained by changing the above-mentioned acrylates to methacrylates.

As a polyfunctional crosslinkable monomer, there are given: pentaerythritol triacrylate, trimethylolethane triacrylate, trimethylolpropane triacrylate, tetramethylolmethane tetraacrylate, oligoester acrylate, and methacrylates thereof, 2,2-bis(4-methacryloxy polyethoxyphenyl)propane, diallyl phthalate, triallyl cyanurate, triallyl isocyanurate, triallyl trimellitate, and diallyl chlorendate. The addition amount thereof is preferably from 0.001 mass % to 15.0 mass % with respect to the polymerizable monomer.

When the medium to be used in the suspension polymerization is an aqueous medium, as a dispersion stabilizer for a particle of the polymerizable monomer composition, the following may be used: tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina. In addition, as an organic dispersant, there are given polyvinyl alcohol, gelatin, methylcellulose, methylhydroxypropylcellulose, ethylcellulose, carboxymethylcellulose sodium salt, and starch.

In addition, a commercially available nonionic, anionic, or cationic surfactant can also be utilized. Examples of the surfactant include sodium dodecyl sulfate, sodium tetradecyl sulfate, sodium pentadecyl sulfate, sodium octyl sulfate, sodium oleate, sodium laurate, and potassium stearate.

There is no particular limitation on the colorant to be used in the toner of the present invention, and the following known colorants may be used.

As a yellow pigment, yellow iron oxide, naples yellow, naphthol yellow S, hansa yellow G, hansa yellow 10G, benzidine yellow G, benzidine yellow GR, a quinoline yellow lake, permanent yellow NCG, tartrazine lake, other condensed azo compounds, an isoindoline compound, an anthraquinone compound, an azo metal complex, a methine compound, and an allyl amide compound are used. Specific examples thereof include C.I. Pigment Yellow 12, 13, 14, 15, 17, 62, 74, 83, 93, 94, 95, 109, 110, 111, 128, 129, 147, 155, 168, and 180.

As an orange pigment, there are given permanent orange GTR, pyrazolone orange, Vulcan orange, benzidine orange G, indanthrene brilliant orange RK, and indanthrene brilliant orange GK.

As a red pigment, there are given colcothar, permanent red 4R, lithol red, pyrazolone red, watching red calcium salt, lake red C, lake red D, brilliant carmine 6B, brilliant carmine 3B, eosine lake, rhodamine lake B, alizarin lake, other condensed azo compounds, a diketopyrrolopyrrol compound, anthraquinone, a quinacridone compound, a basic dye lake compound, a naphthol compound, a benzimidazolone compound, a thioindigo compound, and a perylene compound. Specific examples thereof include C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

As a blue pigment, there are given alkali blue lake, Victoria blue lake, phthalocyanine blue, metal-free phthalocyanine blue, a partial chloride of phthalocyanine blue, fast sky blue, indanthrene blue BG, other copper phthalocyanine compounds and derivatives thereof, an anthraquinone compound, and a basic dye lake compound. Specific examples thereof include C.I. Pigment Blue 1, 7, 15, 15:1, 15:2, 15:3, 15:4, 60, 62, and 66.

As a violet pigment, there are given fast violet B and methyl violet lake.

As a green pigment, there are given Pigment Green B, malachite green lake, and final yellow green G. As a white pigment, there are given zinc white, titanium oxide, antimony white, and zinc sulfide.

As a black pigment, there are given carbon black, aniline black, non-magnetic ferrite, magnetite, and a pigment toned to black with the above-mentioned yellow, red, and blue colorants. One kind of those colorants may be used alone, or two or more kinds thereof may be used as a mixture and in the state of a solid solution.

It should be noted that the content of the colorant is preferably from 3.0 parts by mass to 15.0 parts by mass with respect to 100 parts by mass of the binder resin or the polymerizable monomer.

A charge control agent may be used in the toner of the present invention during production thereof, and known charge control agents can be used. The addition amount of any such charge control agent is preferably from 0.01 part by mass to 10.0 parts by mass with respect to 100 parts by mass of the binder resin or the polymerizable monomer.

In the toner of the present invention, various organic or inorganic fine powders may be externally added to the toner particle as necessary. It is preferred that the organic or inorganic fine powders have a particle diameter of 1/10 or less of the weight average particle diameter of the toner particle from the viewpoint of durability at time of addition to the toner particle.

For example, the following fine powder is used as the organic or inorganic fine powder.

(1) Fluidity imparting agents: silica, alumina, titanium oxide, carbon black, and carbon fluoride.
(2) Abrasives: metal oxides (such as strontium titanate, cerium oxide, alumina, magnesium oxide, and chromium oxide), nitrides (such as silicon nitride), carbides (such as silicon carbide), and metal salts (such as calcium sulfate, barium sulfate, and calcium carbonate).
(3) Lubricants: fluorine-based resin powders (such as vinylidene fluoride and polytetrafluoroethylene) and fatty acid metal salts (such as zinc stearate and calcium stearate).
(4) Charge controllable particles: metal oxides (such as tin oxide, titanium oxide, zinc oxide, silica, and alumina) and carbon black.

The surface of the toner particle may be treated with the organic or inorganic fine powder in order to improve the flowability of the toner and to uniformize the charging of the toner particle. As a treatment agent for hydrophobic treatment of the organic or inorganic fine powder, there are given an unmodified silicone varnish, various modified silicone varnishes, an unmodified silicone oil, various modified silicone oils, a silane compound, a silane coupling agent, other organosilicon compounds, and an organotitanium compound. One kind of those treatment agents may be used alone, or two or more kinds thereof may be used in combination.

Various measurement methods related to the present invention are described below.

<NMR Measurement Method (Confirmation of Partial Structure Represented by Formula (1))>

The partial structure represented by the formula (1) in the organosilicon polymer contained in the toner particle was confirmed by the following solid NMR measurement. The measurement conditions and sample preparation method are as follows.

"Measurement Conditions"

Apparatus: JNM-EX400 manufactured by JEOL Ltd.
Probe: 6 mm CP/MAS probe
Measurement temperature: room temperature
Reference substance: polydimethylsilane (PDMS), external reference: −34.0 ppm
Measured nucleus: $^{29}$Si (resonance frequency: 79.30 MHz)
Pulse mode: CP/MAS
Pulse width: 6.4 μsec
Repetition time: ACQTM=25.6 msec, PD=15.0 sec
Data points: POINT=4096, SAMPO=1024
Contact time: 5 msec
Spectrum width: 40 kHz
Sample spinning rate: 6 kHz
Number of scans: 2,000 scans
Sample: 200 mg of a measurement sample (its preparation method is described below) is loaded into a sample tube having a diameter of 6 mm.

Preparation of a measurement sample: 10.0 g of toner particles are weighed and loaded into a cylindrical paper filter (manufactured by Toyo Roshi Kaisha, Ltd., No. 86R). The resultant is subjected to extraction by a Soxhlet extractor for 20 hours through use of 200 ml of tetrahydrofuran (THF) as a solvent. The residue in the cylindrical paper filter is dried in vacuum at 40° C. for several hours, and the resultant is defined as a THF-insoluble matter of the toner particle for NMR measurement.

After the measurement, a plurality of silane components having different substituents and bonding groups of the toner particle are subjected to peak division by curve fitting into the following Q1 structure, Q2 structure, Q3 structure, and Q4 structure, and mol % of each component is calculated from an area ratio of the peaks.

Software EXcalibur for Windows (trademark) version 4.2 (EX series) for JNM-EX400 manufactured by JEOL Ltd. was used for the curve fitting. Measurement data is opened by clicking "1D Pro" in menu icons.

Next, "Curve fitting function" was selected from "Command" of a menu bar, and then curve fitting was performed. An example thereof is shown in FIG. 1. Peak division was performed so that a peak of a synthesis peak difference (a) that is a difference between a synthesis peak (b) and a measurement result (d) became minimum.

An area for the Q1 structure, an area for the Q2 structure, an area for the Q3 structure, and an area for the Q4 structure are determined, and SQ1, SQ2, SQ3, and SQ4 are determined by the following formulae.

Q1 structure: $(R^i)(R^j)(R^k)SiO_{1/2}$ Formula (5)

Q2 structure: $(R^g)(R^h)Si(O_{1/2})_2$ Formula (6)

Q3 structure: $R^fSi(O_{1/2})_3$ Formula (7)

Q4 structure: $Si(O_{1/2})_4$ Formula (8)

(5)

Q1:

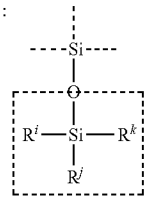

(6)

Q2:

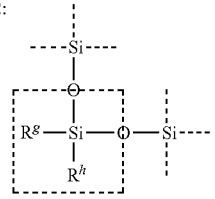

(7)

Q3:

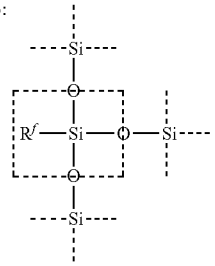

(8)

Q4:

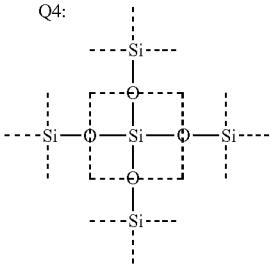

(In the formulae (5), (6), and (7), $R^f$, $R^g$, $R^h$, $R^i$, $R^j$, and $R^k$ each represent an organic group, a halogen atom, a hydroxy group, or an alkoxy group bonded to silicon.)

In the present invention, a silane monomer is identified by a chemical shift value, and in $^{29}$Si-NMR measurement of the toner particle, from a total peak area, a total of the area for the Q1 structure, the area for the Q2 structure, the area for the Q3 structure, and the area for the Q4 structure is defined as a total peak area for the organosilicon polymer.

SQ1+SQ2+SQ3+SQ4=1.00

SQ1={area for Q1 structure/(area for Q1 structure+area for Q2 structure+area for Q3 structure+area for Q4 structure)}

SQ2={area for Q2 structure/(area for Q1 structure+area for Q2 structure+area for Q3 structure+area for Q4 structure)}

SQ3={area for Q3 structure/(area for Q1 structure+area for Q2 structure+area for Q3 structure+area for Q4 structure)}

SQ4={area for Q4 structure/(area for Q1 structure+area for Q2 structure+area for Q3 structure+area for Q4 structure)}

In the present invention, the ratio of the peak area for the partial structure represented by the formula (1) to the total peak area for the organosilicon polymer is 5.0% or more. In this measurement method, the value indicating the $—SiO_{3/2}$ structure is the SQ3. This value is 0.050 or more.

$$R^0—SiO_{2/3} \quad (1)$$

Chemical shift values of silicon in the Q1 structure, the Q2 structure, the Q3 structure, and the Q4 structure are shown below.

An example of the Q1 structure ($R^i$=$R^j$=—$OC_2H_5$, $R^k$=—$CH_3$): −47 ppm

An example of the Q2 structure ($R^g$=—$OC_2H_5$, $R^h$=—$CH_3$): −56 ppm

An example of the Q3 structure ($R^f$=—$CH_3$): −65 ppm

Further, a chemical shift value of silicon in the case where the Q4 structure is present is shown below. Q4 structure: −108 ppm

[Confirmation Method for Partial Structure Represented by Formula (1)]

The presence/absence of an organic group represented by $R^0$ in the formula (1) is confirmed by $^{13}$C-NMR.

Further, the detailed structure of the formula (1) is confirmed by $^1$H-NMR, $^{13}$C-NMR, and $^{29}$Si-NMR. An apparatus and measurement conditions used are as follows.

"Measurement Conditions"

Apparatus: AVANCE III 500 manufactured by Bruker Corporation

Probe: 4 mm MAS BB/1H

Measurement temperature: room temperature

Sample spinning rate: 6 kHz

Sample: 150 mg of a measurement sample (THF-insoluble matter of the toner particle for the NMR measurement) is loaded into a sample tube having a diameter of 4 mm.

The presence/absence of the organic group represented by $R^0$ in the formula (1) was confirmed by the method. The structure represented by the formula (1) is "present" when a signal is confirmed.

"$^{13}$C-NMR (Solid) Measurement Conditions"

Measured nucleus frequency: 125.77 MHz

Reference substance: glycine (external standard: 176.03 Ppm)

Measurement width: 37.88 kHz

Measurement method: CP/MAS

Contact time: 1.75 ms

Repetition time: 4 s

Number of scans: 2,048 scans

LB value: 50 Hz

It should be noted that, in the present invention, in the case where the organic fine powder or the inorganic fine powder is externally added to the toner, the organic fine powder or the inorganic fine powder is removed by the following method to obtain toner particles.

160 g of sucrose (manufactured by Kishida Chemical Co., Ltd.) is added to 100 mL of ion-exchanged water and dissolved through use of a water bath, to thereby prepare a sucrose concentrated solution. 31 g of the sucrose concentrated solution and 6 mL of Contaminon N (10 mass % aqueous solution of a neutral detergent having a pH of 7 for cleaning a precision measuring instrument containing a nonionic surfactant, an anionic surfactant, and an organic builder, manufactured by Wako Pure Chemical Industries, Ltd.) are put into a centrifugation tube, to thereby produce a dispersion liquid. 1.0 g of the toner is added to the dispersion liquid, and a toner lump is broken with a spatula or the like.

The centrifugation tube is shaken by a shaker at 350 strokes per min (spm) for 20 minutes. After shaking, the solution is transferred into a glass tube for a swing rotor (50 mL) and subjected to centrifugation by a centrifugal separator at 3,500 rpm for 30 minutes. With this operation, the solution is separated into toner particle and external additives detached from the toner particle. It is confirmed visually that the toner and the aqueous solution have been sufficiently separated, and the toner separated into an uppermost layer is collected with a spatula or the like. The collected toner is filtered by a vacuum filter and then dried by a drier for 1 hour or more, to thereby obtain toner particles. This operation is performed a plurality of times to obtain a required amount.

<Measurement Methods for Arithmetic Average Roughness (Ra), Standard Deviation (σRa) of Ra, Average Length (RSm) of Roughness Curve Element, and Standard Deviation (σRSm) of RSm of Toner Particle Surface by SPM>

The measurement of an arithmetic average roughness (Ra), a standard deviation (σRa) of Ra, an average length (RSm) of a roughness curve element, and a standard deviation (σRSm) of RSm of the toner particle surface by an SPM was performed by the following measurement apparatus under the following measurement conditions.

Scanning probe microscope: manufactured by Hitachi High-Tech Science Corporation Measurement unit: E-sweep Measurement mode: DFM (resonance mode) topography image Resolution: number of X data: 256, number of Y data: 128

Measurement area: 1 μm square (1 μm×1 μm)

It should be noted that, in the present invention, in the case where the organic fine powder or the inorganic fine powder is externally added to the toner, the organic fine powder or the inorganic fine powder is removed by the above-mentioned method to obtain toner particles.

Further, as the toner particle, toner particle having a particle diameter equal to a weight average particle diameter (D4) measured by a Coulter counter method described later was selected and targeted for measurement. Further, ten different toner particles were subjected to measurement.

[Calculation Method for Arithmetic Average Roughness (Ra)]

The measured data was analyzed with a "surface roughness analysis" screen in a "three-dimensional tilt correction" mode, and an average value of the obtained data was calculated as the arithmetic average roughness (average surface roughness) (Ra) of the toner particle.

[Definition and Calculation Method for Standard Deviation (σRa) of Ra]

Figure 2:
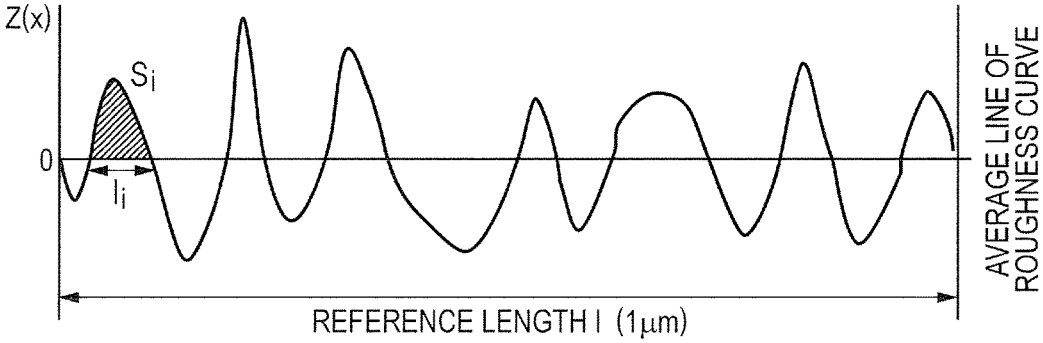
FIG. 2 is a graph for showing a method of calculating an arithmetic average roughness Ra of a toner particle measured by using a scanning probe microscope and a standard deviation σRa of Ra in the present invention.

The standard deviation (σRa) of Ra was defined as follows. First, ten cross-sections (cross-section 1 to cross-section 10) were selected at random from a measured square measurement area measuring 1 μm per side. Herein, the cross-section 1 is described as an example. As shown in FIG. 2, with an average line of a roughness curve being a reference, an area $S_i$ of each area surrounded by each peak and each valley and a reference line length $l_i$ of each area surrounded by each peak and each valley were measured. A height (depth) $Ra_i$ of each peak and each valley from the reference line was calculated by the following expression.

$$Ra_i = \frac{S_i}{l_i}.$$

Regarding all the peaks and valleys existing in the direction of the reference line of the cross-section 1, $Ra_i$ was calculated by the above-mentioned expression, and an average value Ra' thereof was calculated by the following expression.

$$Ra' = \frac{\sum_{i=1}^{n} Ra_i}{n}.$$

n: Total number of peaks and valleys in cross-section 1

A standard deviation σRa' of Ra' in the cross-section 1 was calculated by the following expression.

$$\sigma Ra' = \sqrt{\frac{\sum_{i=1}^{n} (Ra_i - Ra')^2}{n-1}}$$

n: Total number of peaks and valleys in cross-section 1

The σRa' was calculated for all the cross-section 1 to the cross-section 10, and an average value thereof was calculated as the standard deviation σRa of Ra of the toner particle.

[Calculation Method for Average Length (RSm, RSm1, RSm2) of Roughness Curve Element]

Figure 3:
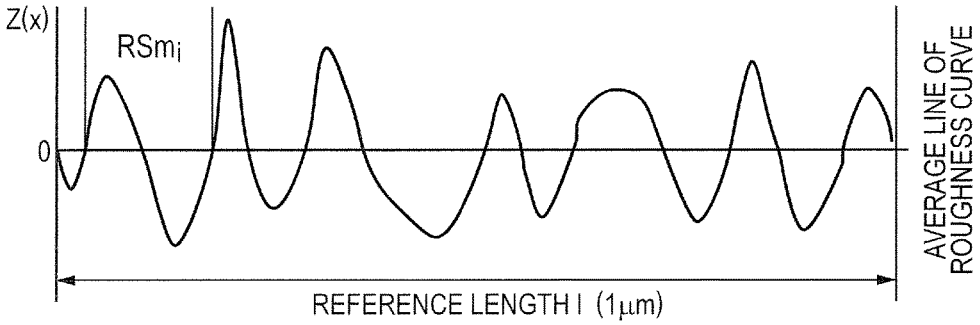
FIG. 3 is a graph for showing a method of calculating an average length RSm of a roughness curve element of the toner particle measured by using a scanning probe microscope and a standard deviation σRSm of RSm in the present invention.

The average length RSm of the roughness curve element was calculated as follows. First, ten cross-sections (cross-section 1 to cross-section 10) were selected at random from a measured square measurement area measuring 1 μm per side. Herein, the cross-section 1 is described as an example. As shown in FIG. 3, with an average line of a roughness curve being a reference, a length $RSm_i$ of a portion in which irregularities of one period were formed was measured for all irregularity periods. An average length RSm' of the roughness curve element in the cross-section 1 was calculated by the following expression. RSm1' of toner and RSm2' of treated-toner are calculated in the same manner.

$$RSm' = \frac{1}{n}\sum_{i=1}^{n} RSm_i.$$

n: Total number of irregularity periods in cross-section 1

The RSm' in the cross-section 1 to the cross-section 10 was all calculated, and an average value thereof was calculated as the average length RSm of the roughness curve element of the toner particle. The RSm1 of toner and the RSm2 of treated-toner are calculated in the same manner.

[Calculation Method for Standard Deviation (σRSm) of RSm]

The standard deviation σRSm of RSm was defined as follows. First, the standard deviation σRSm' of RSm' in the cross-section 1 was calculated by the following expression in the calculation method for RSm' of the cross-section 1.

$$\sigma RSm' = \sqrt{\frac{\sum_{i=1}^{n}(RSm_i - RSm')^2}{n-1}}$$

n: Total number of irregularity periods in cross-section 1

The σRSm' in the cross-section 1 to cross-section 10 was all calculated, and an average value thereof was calculated as the standard deviation σRSm of RSm of the toner particle.

<Measurement Methods for Weight Average Particle Diameter (D4) and Number Average Particle Diameter (D1) of Toner Particle>

The weight average particle diameter (D4) and the number average particle diameter (D1) of the toner particle were measured with the number of effective measurement channels of 25,000 by using a precision particle size distribution measuring apparatus based on a pore electrical resistance method provided with a 100 μm aperture tube "Coulter Counter Multisizer 3" (trademark manufactured by Beckman Coulter, Inc.) and dedicated software included thereto "Beckman Coulter Multisizer 3 Version 3.51" (manufactured by Beckman Coulter, Inc.) for setting measurement conditions and analyzing measurement data. Then, the measurement data was analyzed to calculate the diameters.

An electrolyte aqueous solution prepared by dissolving reagent grade sodium chloride in ion-exchanged water so as to have a concentration of about 1 mass %, for example, "ISOTON II" (manufactured by Beckman Coulter, Inc.) can be used in the measurement.

It should be noted that the dedicated software is set as described below prior to the measurement and the analysis.

In the "change standard measurement method (SOM)" screen of the dedicated software, the total count number of a control mode is set to 50,000 particles, the number of times of measurement is set to 1, and a value obtained by using "standard particles having a particle diameter of 10.0 μm" (manufactured by Beckman Coulter, Inc.) is set as a Kd value. A threshold and a noise level are automatically set by pressing a threshold/noise level measurement button. In addition, a current is set to 1,600 μA, a gain is set to 2, and an electrolyte solution is set to ISOTON II, and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to the range of 2 μm or more and 60 μm or less.

A specific measurement method is as described below.

(1) About 200 ml of the electrolyte aqueous solution is charged into a 250 ml round-bottom beaker made of glass dedicated for Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "aperture flush" function of the dedicated software.

(2) About 30 ml of the electrolyte aqueous solution is charged into a 100 ml flat-bottom beaker made of glass. About 0.3 ml of a diluted solution prepared by diluting "Contaminon N" (a 10 mass % aqueous solution of a neutral detergent for washing a precision measuring device formed of a nonionic surfactant, an anionic surfactant, and an organic builder and having a pH of 7 manufactured by Wako Pure Chemical Industries, Ltd.) with ion-exchanged water by three parts by mass fold is added as a dispersant to the electrolyte aqueous solution.

(3) An ultrasonic dispersing unit "Ultrasonic Dispension System Tetora 150" (manufactured by Nikkaki Bios Co., Ltd.) in which two oscillators each having an oscillatory frequency of 50 kHz are built so as to be out of phase by 180° and which has an electrical output of 120 W is prepared. A predetermined amount of ion-exchanged water is charged into the water tank of the ultrasonic dispersing unit. About 2 ml of the Contaminon N is charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate with an ultrasonic wave from the ultrasonic dispersing unit to the fullest extent possible.

(5) About 10 mg of the toner particles are gradually added to and dispersed in the electrolyte aqueous solution in the beaker in the section (4) under a state in which the electrolyte aqueous solution is irradiated with the ultrasonic wave. Then, the ultrasonic dispersion treatment is continued for an additional 60 seconds. It should be noted that the temperature of water in the water tank is appropriately adjusted so as to be 10° C. or more and 40° C. or less upon ultrasonic dispersion.

(6) The electrolyte aqueous solution in the section (5) in which the toner particles have been dispersed is dropped with a pipette to the round-bottom beaker in the section (1) placed in the sample stand, and the concentration to be measured is adjusted to about 5%. Then, measurement is performed until the particle diameters of 50,000 particles are measured.

(7) The measurement data is analyzed with the dedicated software included with the apparatus, and the weight average particle diameter (D4) calculated. It should be noted that an "average diameter" on the "analysis/volume statistics (arithmetic average)" screen of the dedicated software when the dedicated software is set to show a graph in a vol % unit is the weight average particle diameter (D4), and an "average diameter" on the "analysis/number statistics (arithmetic average)" screen of the dedicated software when the dedicated software is set to show a graph in a number % unit is the number average particle diameter (D1).

<Density of Silicon Atom (Atomic %) Existing in Surface of Toner Particle>

The density of a silicon atom [dSi] (atomic %), the density of a carbon atom [dC] (atomic %), and the density of an oxygen atom [dO] (atomic %), the atoms existing in the surface of the toner particle, are calculated by performing surface composition analysis through use of X-ray photoelectron spectroscopic analysis (ESCA: Electron Spectroscopy for Chemical Analysis).

In the present invention, an apparatus and measurement conditions for ESCA are as follows.

Used apparatus: Quantum 2000 manufactured by ULVAC-PHI, Inc.

X-ray photoelectron spectrometer measurement conditions:

X-ray source: Al Kα

X-ray: 100 μm, 25 W, 15 kV

Raster: 300 μm×200 μm

Pass energy: 58.70 eV

Step size: 0.125 eV

Neutralization electron gun: 20 μA, 1 V

Ar ion gun: 7 mA, 10 V

Number of sweeps: Si: 15 sweeps, C: 10 sweeps, O: 10 sweeps

In the present invention, the density of a silicon atom [dSi] (atomic %), the density of a carbon atom [dC] (atomic %), and the density of an oxygen atom [dO] (atomic %), the atoms existing in the surface layer of the toner particle, were calculated through use of a relative sensitivity factor manufactured by PHI, Inc. based on the measured peak intensity of each element. Then, a ratio of the density of a silicon atom dSi (atomic %) to a total (dC+dO+dSi) of the density of a carbon atom dC, the density of an oxygen atom dO, and the density of a silicon atom dSi of 100.0 atomic % in the surface layer of the toner particle was determined.

EXAMPLES

The present invention is described below in more detail by way of specific production methods, Examples, and Comparative Examples. However, the present invention is by no means limited thereto. It should be noted that the number of parts and % in Examples and Comparative Examples are all based on a mass unless otherwise specified.

<Production Example of Silica Particles 1>

589.6 g of methanol, 42.0 g of water, and 47.1 g of 28 mass % ammonia water were added to be mixed in a 3 L glass reaction vessel provided with a stirrer, a dropping funnel, and a thermometer. The obtained solution was adjusted to 35° C., and 1,100.0 g (7.23 mol) of tetramethoxysilane and 395.2 g of 5.4 mass % ammonia water were simultaneously started to be added to the solution with stirring. Tetramethoxysilane was dropped over 6 hours, and ammonia water was dropped over 5 hours. After the dropping was finished, the resultant was subjected to hydrolysis by further continuing stirring for 0.5 hour, to thereby obtain a methanol-water dispersion liquid of hydrophilic spherical sol-gel silica fine particles. Then, an ester adaptor and a cooling tube were mounted on the glass reaction vessel, and the dispersion liquid was sufficiently dried at 80° C. under reduced pressure. The obtained silica particles were heated at 400° C. for 10 minutes in a thermostat.

The above-mentioned step was performed a plurality of times, and the obtained silica particles were subjected to crushing treatment by a pulverizer (manufactured by Hosokawa Micron Corporation).

Then, a surface treatment step was performed as described below. First, 500 g of silica particles were loaded into a polytetrafluoroethylene inner cylindrical stainless autoclave having a content volume of 1,000 mL. Then, the inside of the autoclave was replaced by nitrogen gas. Then, 3.5 g of hexamethyldisilazane (HMDS) (surface treatment agent) and 1.0 g of water were uniformly sprayed onto the silica particles in an atomized shape through a two-fluid nozzle while an accompanying stirring blade of the autoclave was rotated at 400 rpm. After stirring for 30 minutes, the autoclave was sealed and heated at 200° C. for 2 hours. Then, the system was reduced in pressure while being heated and subjected to deammoniation treatment, to thereby obtain silica particles 1.

An average particle diameter of primary particles of the silica particles 1 was measured as follows. Silica inorganic fine particles were observed with a transmission electron microscope, and in a field of view magnified by from 30,000 times to 50,000 times, an average value of long diameters was calculated for 300 primary particles each having a long diameter of 1 nm or more. It should be noted that, in the case where the sampled particles were small to such a degree that particle diameters thereof were not able to be measured even at a magnification ratio of 50,000, a photograph was further enlarged so that each primary particle diameter of the particles in the photograph became 5 mm or more, and thus a measurement was performed. Each physical property of the silica particles 1 is shown in Table 1.

<Production Examples of Silica Particles 2 and 3>

Silica particles 2 and 3 were produced by the same method as that of the production example of the silica particles 1 except that the amount of methanol to be used initially was changed from 589.6 g to 835.4 g and 277.6 g, respectively. With this change, a volume average particle diameter (Dv) of the silica particles and a coefficient of variation in a volume particle size distribution of the silica particles were adjusted. Each physical property of the silica particles 2 and 3 is shown in Table 1.

<Production Example of Silica Particles 4>

Silica particles 4 were produced by the same method as that of the production example of the silica particles 1 except that the dropping time of tetramethoxysilane was changed from 6 hours to 3 hours, and the dropping time of 5.4 mass % ammonia water was changed from 5 hours to 3 hours. With this change, a coefficient of variation in a volume particle size distribution of the silica particles was adjusted. Each physical property of the silica particles 4 is shown in Table 1.

<Production Example of Silica Particles 5>

Silica particles 5 were produced by the same method as that of the production example of the silica particles 1 except that the HDMS treatment was not performed. Each physical property of the silica particles 5 is shown in Table 1.

<Production Examples of Silica Particles 6 and 7>

Silica particles 6 and 7 were produced by the same method as that of the production example of the silica particles 1 except that the amount of methanol to be used initially was changed from 589.6 g to 1,004.5 g and 187.3 g, respectively. With this change, a volume average particle diameter (Dv) of the silica particles and a coefficient of variation in a volume particle size distribution of the silica particles were adjusted. Each physical property of the silica particles 6 and 7 is shown in Table 1.

<Production Example of Silica Particles 8>

Silica particles 8 were produced by the same method as that of the production example of the silica particles 1 except that the dropping time of tetramethoxysilane was changed from 6 hours to 1 hour, the dropping time of 5.4 mass % ammonia water was changed from 5 hours to 1 hour, and the crushing treatment was not performed. With this change, a coefficient of variation in a volume particle size distribution of the silica particles was adjusted. Each physical property of the silica particles 8 is shown in Table 1.

<Production Example of Titanium Particles 1>

Ilmenite ore containing 50 mass % of a portion equivalent to $TiO_2$ was dried at 150° C. for 3 hours, and was then dissolved by adding sulfuric acid, to thereby obtain an aqueous solution of $TiOSO_4$. The obtained aqueous solution was concentrated, and then 10 parts by mass of titania sol containing a rutile crystal was added as a seed to the concentrated aqueous solution. Then, the resultant was subjected to hydrolysis at 170° C., to thereby obtain a slurry of $TiO(OH)_2$ containing impurities.

The slurry was repeatedly washed at a pH of from 5 to 6 to sufficiently remove sulfuric acid, $FeSO_4$, and the impurities, to thereby obtain a high-purity slurry of metatitanic acid [$TiO(OH)_2$].

The slurry was filtered, and 0.5 part by mass of lithium carbonate ($Li_2CO_3$) was added to the resultant, followed by firing at 240° C. for 4 hours. Then, the resultant was repeatedly subjected to crushing treatment by a jet mill, to thereby obtain titanium oxide fine particles containing a rutile type crystal.

While the obtained titanium oxide fine particles were dispersed and stirred in ethanol, 5 parts by mass of isobutyltrimethoxysilane were dropped as a surface treatment agent to be mixed and reacted with 100 parts by mass of the titanium oxide fine particles. After drying, the resultant was subjected to heat treatment at 170° C. for 3 hours and repeatedly subjected to crushing treatment by a jet mill until an aggregate of titanium oxide disappeared, to thereby obtain titanium particles 1. The physical properties of the titanium particles 1 are shown in Table 1.

TABLE 1

| Silica particles | Production method | Surface treatment agent | Volume average particle diameter (Dv) (nm) | Coefficient of variation in volume particle size distribution (%) |
|---|---|---|---|---|
| Silica particles 1 | Sol-gel method | HDMS | 105 | 13 |
| Silica particles 2 | Sol-gel method | HDMS | 24 | 15 |
| Silica particles 3 | Sol-gel method | HDMS | 610 | 16 |
| Silica particles 4 | Sol-gel method | HDMS | 110 | 22 |
| Silica particles 5 | Sol-gel method | None | 110 | 12 |
| Silica particles 6 | Sol-gel method | HDMS | 9 | 18 |
| Silica particles 7 | Sol-gel method | HDMS | 1,030 | 11 |
| Silica particles 8 | Sol-gel method | HDMS | 130 | 40 |
| Titania particles 1 | | | 275 | 18 |

<Production Example of Polyester-Based Resin 1>

| | |
|---|---|
| Terephthalic acid | 21 parts by mass |
| Isophthalic acid | 21 parts by mass |
| Bisphenol A-propylene oxide (2 mol) adduct | 89.5 parts by mass |
| Bisphenol A-propylene oxide (3 mol) adduct | 23.0 parts by mass |
| Potassium oxalate titanate | 0.030 part by mass |

The above-mentioned materials were loaded into an autoclave provided with a decompressor, a water separation device, a nitrogen gas introducing device, a temperature measurement device, and a stirring device and were allowed to react at 220° C. for 15 hours under ordinary pressure under a nitrogen atmosphere. Further, the resultant was allowed to react for 1 hour under a reduced pressure of from 10 mmHg to 20 mmHg, to thereby obtain a polyester-based resin 1. The polyester-based resin 1 had a Tg of 74.8° C. and an acid value of 8.2.

<Production Example of Polyester-Based Resin 2>

Terephthalic acid: 11.0 mol

Bisphenol A-propylene oxide (2 mol) adduct (PO-BPA): 10.9 mol

The above-mentioned materials were loaded into an autoclave together with an esterification catalyst, and a decompressor, a water separation device, a nitrogen gas introducing device, a temperature measurement device, and a stirring device were mounted on the autoclave. While the pressure was reduced under a nitrogen atmosphere, the materials were allowed to react at 210° C. by an ordinary method until Tg reached 68° C., to thereby obtain a polyester-based resin 2. The polyester-based resin 2 had a weight average molecular weight (Mw) of 7,400 and a number average molecular weight (Mn) of 3,020.

<Production Example of Polyester-Based Resin 3>

| (Synthesis of Isocyanate Group-containing Prepolymer) | |
|---|---|
| Bisphenol A-ethylene oxide (2 mol) adduct | 725 parts by mass |
| Phthalic acid | 290 parts by mass |
| Dibutyltin oxide | 3.0 parts by mass |

The above-mentioned materials were allowed to react with stirring at 220° C. for 7 hours and further allowed to react under reduced pressure for 5 hours. Then, the resultant was cooled to 80° C. and allowed to react with 190 parts by mass of isophorone diisocyanate in ethyl acetate for 2 hours, to thereby obtain an isocyanate group-containing polyester resin. 25 Parts by mass of the isocyanate group-containing polyester resin and 1 part by mass of isophorone diamine were allowed to react at 50° C. for 2 hours, to thereby obtain a polyester-based resin 3 containing, as a main component, polyester containing a urea group. The obtained polyester-based resin 3 had a weight average molecular weight (Mw) of 22,300, a number average molecular weight (Mn) of 2,980, and a peak molecular weight of 7,200.

<Production Example of Toner Particles 1>

700 Parts by mass of ion-exchanged water, 1,000 parts by mass of a 0.1 mol/L $Na_3PO_4$ aqueous solution, and 22.0 parts by mass of a 1.0 mol/L HCl aqueous solution were added to a four-necked vessel provided with a reflux tube, a stirrer, a thermometer, and a nitrogen introducing tube. The mixture was kept at 60° C. with stirring at 12,000 rpm through use of a high-speed stirring device TK-homomixer. 85 Parts by mass of a 1.0 mol/L $CaCl_2$ aqueous solution were gradually added to the resultant, to thereby prepare an aqueous dispersion medium containing a fine poorly water-soluble dispersion stabilizer $Ca_3(PO_4)_2$.

After that, a polymerizable monomer composition was produced by using the following raw materials.

| | |
|---|---|
| Styrene monomer | 75.0 parts by mass |
| n-Butyl acrylate | 25.0 parts by mass |
| Divinylbenzene | 0.1 part by mass |
| Organosilicon compound (methyltriethoxysilane) | 8.0 parts by mass |
| Copper phthalocyanine pigment (Pigment Blue 15:3) | 6.5 parts by mass |
| Polyester-based resin 1 | 5.0 parts by mass |
| Charge control agent BONTRON E-88 (manufactured by Orient Chemical Industries Co., Ltd.) | 0.7 part by mass |
| Paraffin wax (HNP-5: manufactured by Nippon Seiro Co., Ltd., melting point: 60° C.) | 9.0 parts by mass |

The above-mentioned raw materials were dispersed with an attritor (manufactured by Nippon Coke & Engineering Co., Ltd.) for 3 hours to obtain a polymerizable monomer composition. Then, the polymerizable monomer composition was transferred into another vessel and kept at 60° C. for 20 minutes with stirring. Then, 16.0 parts by mass of t-butyl peroxypivalate (50% toluene solution) serving as a polymerization initiator were added to the polymerizable monomer composition, and the resultant was kept for 5 minutes with stirring. Then, the polymerizable monomer composition was loaded into the aqueous dispersion medium and granulated for 10 minutes with stirring by a high-speed stirring device.

After that, the high-speed stirring device was replaced by a propeller type stirrer, and the internal temperature was raised to 70° C. Thus, the polymerizable monomer composition was allowed to react for 4 hours with slow stirring (reaction 1 step). The pH was 5.5.

Meanwhile, 1.5 parts by mass of the silica particles 1 and 3.0 parts by mass of methyltriethoxysilane were loaded into an autoclave provided with a nitrogen gas introducing device, a temperature measurement device, and a stirring device, and the mixture was allowed to react at 70° C. for 5 hours under ordinary pressure under a nitrogen atmosphere, to thereby produce a silica particle dispersion liquid.

The silica particle dispersion liquid was added to the polymer slurry in which the reaction 1 step was finished, and the inside of the vessel was raised to a temperature of 85° C. and kept in this state for 3.0 hours (reaction 2 step). Then, 300 parts by mass of ion-exchanged water were added to the resultant. The reflux tube was removed, and a distillation device was mounted on the vessel. Distillation was performed for 4 hours at a temperature in the vessel of 100° C. to remove a residual monomer and toluene, to thereby obtain a polymer slurry (reaction 3 step). Then, the inside of the vessel was cooled to 85° C. After that, 13.0 parts by mass of 1.0 N NaOH were added to the resultant while keeping the temperature to adjust the pH to 9.0. Then, the reaction was performed at 85° C. for further 4 hours (reaction 4 step). Dilute hydrochloric acid was added to the vessel containing the polymer slurry after cooling to 30° C. to remove the dispersion stabilizer. Further, filtration, washing, and drying were performed, and then fine and coarse powders were cut off by pneumatic classification to obtain toner particles 1. The formulation and conditions of the toner particles 1 are shown in Table 2 and Table 3, and the physical properties thereof are shown in Table 4. In Table 3, "ESCA dSi value" represents ratio of density of silicon atom dSi to total density (dC+dO+dSi) of density of carbon atom dC, density of oxygen atom dO, and density of silicon atom dSi in X-ray photoelectron spectroscopic analysis of surface of toner particle.

<Production Examples of Toner Particles 2 and Toner Particles 4 to 12, 14, and 15>

Toner particles 2 and toner particles 4 to 12, 14, and 15 were obtained in the same manner as in the production example of the toner particles 1 except that the composition amounts and production conditions of polymerizable monomer compositions shown in Table 2 were used, and the kinds of organosilicon compounds and particles having large particle diameter shown in Table 3 were used. The physical properties of the obtained particles are shown in Table 4.

<Production Example of Toner Particles 3>

Toner particles 3 were obtained by the same method as that of the production example of the toner particles 1 except that the silica particles 1 were changed to polymethyl methacrylate resin fine particles (crosslinking-type PMMA particles, MP1451 manufactured by Soken Chemical & Engineering Co., Ltd., volume average particle diameter: 150 nm). The physical properties of the obtained particles are shown in Table 4.

<Production Example of Toner Particles 13>

In the production example of the toner particles 1, a method of adding the silica particle dispersion liquid was changed as follows. First, 1.5 parts by mass of the silica particles 1 and 3.0 parts by mass of methyltriethoxysilane were loaded into an autoclave provided with a nitrogen gas introducing device, a temperature measurement device, and a stirring device and were allowed to react at 70° C. for 5 hours under ordinary pressure under a nitrogen atmosphere, to thereby produce a silica particle dispersion liquid. The silica particle dispersion liquid was divided in equal amounts into two vessels to obtain a silica particle dispersion liquid A and a silica particle dispersion liquid B. First, the silica particle dispersion liquid A was added to a polymer slurry in which the reaction 1 step was finished. Then, the silica particle dispersion liquid B was added to a polymer slurry in which the reaction 3 step was finished, and the reaction 4 was allowed to proceed. Toner particles 13 were obtained by the same method as that of the production example of the toner particles 1 except for the foregoing. The physical properties of the obtained particles are shown in Table 4.

<Production Example of Toner Particles 16>

700 Parts by mass of ion-exchanged water, 1,000 parts by mass of a 0.1 mol/L $Na_3PO_4$ aqueous solution, and 22.0 parts by mass of a 1.0 mol/L HCl aqueous solution were added to a four-necked vessel provided with a reflux tube, a stirrer, a thermometer, and a nitrogen introducing tube. The mixture was kept at 60° C. with stirring at 12,000 rpm through use of a high-speed stirring device TK-homomixer. 85 Parts by mass of a 1.0 mol/L $CaCl_2$ aqueous solution were gradually added to the resultant, to thereby prepare an aqueous dispersion medium containing a fine poorly water-soluble dispersion stabilizer $Ca_3(PO_4)_2$.

After that, a polymerizable monomer composition was produced by using the following raw materials.

| | |
|---|---|
| Styrene monomer | 75.0 parts by mass |
| n-Butyl acrylate | 25.0 parts by mass |
| Divinylbenzene | 0.1 part by mass |
| Organosilicon compound (methyltriethoxysilane) | 8.0 parts by mass |
| Silica particles 5 | 1.5 parts by mass |
| Copper phthalocyanine pigment (Pigment Blue 15:3) | 6.5 parts by mass |
| Polyester-based resin 1 | 5.0 parts by mass |
| Charge control agent BONTRON E-88 (manufactured by Orient Chemical Industries Co., Ltd.) | 0.7 part by mass |
| Paraffin wax (HNP-5: manufactured by Nippon Seiro Co., Ltd., melting point: 60° C.) | 9.0 parts by mass |

The above-mentioned raw materials were dispersed with an attritor (manufactured by Nippon Coke & Engineering Co., Ltd.) for 3 hours to obtain a polymerizable monomer composition. Then, the polymerizable monomer composition was transferred into another vessel and kept at 60° C. for 20 minutes with stirring. Then, 16.0 parts by mass of t-butyl peroxypivalate (50% toluene solution) serving as a polymerization initiator were added to the polymerizable monomer composition, and the resultant was kept for 5 minutes with stirring. Then, the polymerizable monomer composition was loaded into the aqueous dispersion medium and granulated for 10 minutes with stirring by a high-speed stirring device. After that, the high-speed stirring device was replaced by a propeller type stirrer, and the internal temperature was raised to 70° C. Thus, the polymerizable monomer composition was allowed to react for 4 hours with slow stirring (reaction 1 step). The pH was 5.5. After that, the inside of the vessel was raised to a temperature of 85° C. and kept in this state for 3.0 hours (reaction 2 step). Then, 300 parts by mass of ion-exchanged water were added to the resultant. The reflux tube was removed, and a distillation device was mounted on the vessel. Distillation was performed for 4 hours at a temperature in the vessel of 100° C. to remove a residual monomer and toluene, to thereby obtain a polymer slurry (reaction 3 step). Then, the inside of the vessel was cooled to 85° C. After that, 13.0 parts by mass of 1.0 N NaOH were added to the resultant while keeping the temperature to adjust the pH to 9.0. Then, the reaction was performed at 85° C. for further 4 hours (reaction 4 step). Dilute hydrochloric acid was added to the vessel containing the polymer slurry after cooling to 30° C. to remove the dispersion stabilizer. Further, filtration, washing, and drying were performed, and then fine and coarse powders were cut off by pneumatic classification to obtain toner particles 16. The formulation and conditions of the toner particles 16 are shown in Table 2 and Table 3, and the physical properties thereof are shown in Table 4.

<Production Example of Toner Particles 17>

| | |
|---|---|
| Polyester-based resin 2 | 60.0 parts by mass |
| Polyester-based resin 3 | 40.0 parts by mass |
| Copper phthalocyanine pigment (Pigment Blue 15:3) | 6.5 parts by mass |
| Organosilicon compound (methyltriethoxysilane) | 5.0 parts by mass |
| Charge control agent BONTRON E-88 (manufactured by Orient Chemical Industries Co., Ltd.) | 0.7 part by mass |
| Paraffin wax (HNP-5: manufactured by Nippon Seiro Co., Ltd., melting point: 60° C.) | 9.0 parts by mass |

The above-mentioned materials were dissolved in 400 parts by mass of toluene to obtain a solution.

700 Parts by mass of ion-exchanged water, 1,000 parts by mass of a 0.1 mol/L $Na_3PO_4$ aqueous solution, and 22.0 parts by mass of a 1.0 mol/L HCl aqueous solution were added to a four-necked vessel provided with a Liebig reflux tube. The mixture was kept at 60° C. with stirring at 12,000 rpm through use of a high-speed stirring device TK-homomixer. 85 Parts by mass of a 1.0 mol/L $CaCl_2$ aqueous solution were gradually added to the resultant, to thereby prepare an aqueous dispersion medium containing a fine poorly water-soluble dispersion stabilizer $Ca_3(PO_4)_2$.

Next, 100 parts by mass of the above-mentioned solution were loaded into the aqueous dispersion medium with stirring at 12,000 rpm through use of the TK-homomixer, and the mixed solution was stirred for 5 minutes. Then, the mixed solution was kept at 70° C. for 5 hours. The pH was 5.5.

Meanwhile, 1.5 parts by mass of the silica particles 1 and 3.0 parts by mass of methyltriethoxysilane were loaded into an autoclave provided with a nitrogen gas introducing device, a temperature measurement device, and a stirring device, and the mixture was allowed to react at 70° C. for 5 hours under ordinary pressure under a nitrogen atmosphere, to thereby produce a silica particle dispersion liquid.

The produced silica particle dispersion liquid was added to the polymer slurry, and the inside of the vessel was raised to a temperature of 85° C. and kept in this state for 3 hours. Then, 300 parts by mass of ion-exchanged water were added to the resultant. The reflux tube was removed, and a distillation device was mounted on the vessel. Next, distillation was performed for 4 hours at a temperature in the vessel of 100° C., to thereby obtain a polymer slurry. Then, the inside of the vessel was cooled to a temperature of 85° C., and 13.0 parts by mass of 1.0 N NaOH were added to the resultant to adjust the pH to 9.0. The reaction was performed at 85° C. for further 4 hours. Dilute hydrochloric acid was added to the vessel containing the polymer slurry to remove the dispersion stabilizer. Further, filtration, washing, drying, and cutting off of fine and coarse powders by pneumatic classification were performed to obtain toner particles 17. The physical properties thereof are shown in Table 4.

<Production Examples of Comparative Toner Particles 1 and Comparative Toner Particles 3 to 7>

Comparative toner particles 1 and comparative toner particles 3 to 7 were obtained in the same manner as in the production example of the toner particles 1 except that the composition amounts and production conditions of polymerizable monomer compositions shown in Table 2 were used, and the kinds of organosilicon compounds and particles having large particle diameter shown in Table 3 were used. The physical properties of the obtained particles are shown in Table 4.

<Production Example of Comparative Toner Particles 2>

Comparative toner particles 2 were obtained in the same manner as in the production example of the toner particles 1 except that the composition amount and production conditions of a polymerizable monomer composition shown in Table 2 were used, the kind of an organosilicon compound shown in Table 3 was used, the NaOH aqueous solution was not added in the reaction 4 step, and hydrochloric acid was not added after the completion of the reaction 4 step. The physical properties of the obtained particles are shown in Table 4.

<Production Example of Comparative Toner Particles 8>

In the production example of the toner particles 1, a method of adding the silica particle dispersion liquid was changed as follows. First, 1.5 parts by mass of the silica particles 1 and 3.0 parts by mass of methyltriethoxysilane were loaded into an autoclave provided with a nitrogen gas introducing device, a temperature measurement device, and a stirring device and were allowed to react at 70° C. for 5 hours under ordinary pressure under a nitrogen atmosphere, to thereby produce a silica particle dispersion liquid. The silica particle dispersion liquid was divided in equal amounts into three vessels to obtain a silica particle dispersion liquid C, a silica particle dispersion liquid D, and a silica particle dispersion liquid E. First, the silica particle dispersion liquid C was added to a polymer slurry in which the reaction 1 step was finished. Then, after the reaction 3 step was finished, the temperature in the vessel was set to 65° C., and the silica particle dispersion liquid D was added to the polymer slurry to start the reaction 4. After 2.0 hours from the start of the reaction 4, the silica particle dispersion liquid E was added to the polymer slurry. Comparative toner particles 8 were obtained by the same method as that of the production example of the toner particles 1 except for the foregoing. The physical properties of the obtained particles are shown in Table 4.

TABLE 2

| | Monomer mixture composition (parts by mass) | | | | | | | | | Reaction 1 step | |
|---|---|---|---|---|---|---|---|---|---|---|---|
| | Styrene | n-Butyl acrylate | Divinylbenzene | Organosilicon compound | Copper phthalocyanine pigment | Polyester resin | Particles having large particle diameter | Charge control agent | Release agent | Temperature (° C.) | Time (hours) |
| Toner particles 1 | 75.0 | 25.0 | 0.1 | 8.0 | 6.5 | 5.0 | 1.5 | 0.7 | 9.0 | 70 | 4 |
| Toner particles 2 | 75.0 | 25.0 | 0.1 | 8.0 | 6.5 | 5.0 | 1.5 | 0.7 | 9.0 | 70 | 4 |

TABLE 2-continued

| | | | | | | | | | | | |
|---|---|---|---|---|---|---|---|---|---|---|---|
| Toner particles 3 | 75.0 | 25.0 | 0.1 | 8.0 | 6.5 | 5.0 | 1.5 | 0.7 | 9.0 | 70 | 4 |
| Toner particles 4 | 75.0 | 25.0 | 0.1 | 8.0 | 6.5 | 5.0 | 1.5 | 0.7 | 9.0 | 70 | 4 |
| Toner particles 5 | 75.0 | 25.0 | 0.1 | 8.0 | 6.5 | 5.0 | 1.5 | 0.7 | 9.0 | 70 | 4 |
| Toner particles 6 | 75.0 | 25.0 | 0.1 | 5.0 | 6.5 | 5.0 | 1.5 | 0.7 | 9.0 | 70 | 4 |
| Toner particles 7 | 75.0 | 25.0 | 0.1 | 5.0 | 6.5 | 5.0 | 1.5 | 0.7 | 9.0 | 70 | 4 |
| Toner particles 8 | 75.0 | 25.0 | 0.1 | 8.0 | 6.5 | 5.0 | 1.5 | 0.7 | 9.0 | 70 | 4 |
| Toner particles 9 | 75.0 | 25.0 | 0.1 | 8.0 | 6.5 | 5.0 | 1.5 | 0.7 | 9.0 | 70 | 4 |
| Toner particles 10 | 75.0 | 25.0 | 0.1 | 8.0 | 6.5 | 5.0 | 1.5 | 0.7 | 9.0 | 70 | 4 |
| Toner particles 11 | 75.0 | 25.0 | 0.1 | 8.0 | 6.5 | 5.0 | 6.0 | 0.7 | 9.0 | 70 | 4 |
| Toner particles 12 | 75.0 | 25.0 | 0.1 | 8.0 | 6.5 | 5.0 | 0.5 | 0.7 | 9.0 | 70 | 4 |
| Toner particles 13 | 75.0 | 25.0 | 0.1 | 8.0 | 6.5 | 5.0 | 1.5 | 0.7 | 9.0 | 70 | 4 |
| Toner particles 14 | 75.0 | 25.0 | 0.1 | 8.0 | 6.5 | 5.0 | 1.5 | 0.7 | 9.0 | 70 | 4 |
| Toner particles 15 | 75.0 | 25.0 | 0.1 | 8.0 | 6.5 | 5.0 | 1.5 | 0.7 | 9.0 | 70 | 4 |
| Toner particles 16 | 75.0 | 25.0 | 0.1 | 8.0 | 6.5 | 5.0 | 1.5 | 0.7 | 9.0 | 70 | 4 |
| Toner particles 17 | See text | | | | | | | | | | |
| Comparative toner particles 1 | 75.0 | 25.0 | 0.1 | 3.0 | 6.5 | 5.0 | 1.5 | 0.7 | 9.0 | 70 | 4 |
| Comparative toner particles 2 | 75.0 | 25.0 | 0.1 | 2.0 | 6.5 | 5.0 | 1.5 | 0.7 | 9.0 | 70 | 4 |
| Comparative toner particles 3 | 75.0 | 25.0 | 0.1 | 8.0 | 6.5 | 5.0 | 1.5 | 0.7 | 9.0 | 70 | 4 |
| Comparative toner particles 4 | 75.0 | 25.0 | 0.1 | 8.0 | 6.5 | 5.0 | 1.5 | 0.7 | 9.0 | 70 | 4 |
| Comparative toner particles 5 | 75.0 | 25.0 | 0.1 | 8.0 | 6.5 | 5.0 | 1.5 | 0.7 | 9.0 | 70 | 4 |
| Comparative toner particles 6 | 75.0 | 25.0 | 0.1 | 8.0 | 6.5 | 5.0 | 15.0 | 0.7 | 9.0 | 70 | 4 |
| Comparative toner particles 7 | 75.0 | 25.0 | 0.1 | 8.0 | 6.5 | 5.0 | 0.1 | 0.7 | 9.0 | 70 | 4 |
| Comparative toner particles 8 | 75.0 | 25.0 | 0.1 | 8.0 | 6.5 | 5.0 | 1.5 | 0.7 | 9.0 | 70 | 4 |

| | Reaction 2 step | | Reaction 3 (distillation) step | | | Reaction 4 step | |
|---|---|---|---|---|---|---|---|
| | Temperature (° C.) | Time (hours) | Temperature (° C.) | Time (hours) | Distillation method | Temperature (° C.) | Time (hours) |
| Toner particles 1 | 85 | 3.0 | 100 | 4.0 | Ordinary pressure | 85 | 4.0 |
| Toner particles 2 | 85 | 3.0 | 100 | 4.0 | Ordinary pressure | 85 | 4.0 |
| Toner particles 3 | 85 | 3.0 | 100 | 4.0 | Ordinary pressure | 85 | 4.0 |
| Toner particles 4 | 80 | 3.0 | 90 | 7.0 | Reduced pressure | 85 | 4.0 |
| Toner particles 5 | 80 | 3.0 | 85 | 7.0 | Reduced pressure | 85 | 4.0 |
| Toner particles 6 | 80 | 3.0 | 85 | 7.0 | Reduced pressure | 85 | 4.0 |
| Toner particles 7 | 80 | 3.0 | 80 | 7.0 | Reduced pressure | 85 | 4.0 |
| Toner particles 8 | 85 | 3.0 | 100 | 4.0 | Ordinary pressure | 85 | 4.0 |
| Toner particles 9 | 85 | 3.0 | 100 | 4.0 | Ordinary pressure | 85 | 4.0 |

TABLE 2-continued

| | | | | | | | |
|---|---|---|---|---|---|---|---|
| Toner particles 10 | 85 | 3.0 | 100 | 4.0 | Ordinary pressure | 85 | 4.0 |
| Toner particles 11 | 85 | 3.0 | 100 | 4.0 | Ordinary pressure | 85 | 4.0 |
| Toner particles 12 | 85 | 3.0 | 100 | 4.0 | Ordinary pressure | 85 | 4.0 |
| Toner particles 13 | 85 | 3.0 | 100 | 4.0 | Ordinary pressure | 85 | 4.0 |
| Toner particles 14 | 85 | 3.0 | 100 | 1.0 | Ordinary pressure | 85 | 2.0 |
| Toner particles 15 | 85 | 3.0 | 100 | 0.5 | Ordinary pressure | 85 | 1.0 |
| Toner particles 16 | 85 | 3.0 | 100 | 4.0 | Ordinary pressure | 85 | 4.0 |
| Toner particles 17 | | | | See text | | | |
| Comparative toner particles 1 | 75 | 3.0 | 80 | 7.0 | Reduced pressure | 85 | 4.0 |
| Comparative toner particles 2 | 75 | 3.0 | 80 | 2.0 | Reduced pressure | 85 | 4.0 |
| Comparative toner particles 3 | 85 | 3.0 | 100 | 4.0 | Ordinary pressure | 85 | 4.0 |
| Comparative toner particles 4 | 85 | 3.0 | 100 | 4.0 | Ordinary pressure | 85 | 4.0 |
| Comparative toner particles 5 | 85 | 3.0 | 100 | 4.0 | Ordinary pressure | 85 | 4.0 |
| Comparative toner particles 6 | 85 | 3.0 | 100 | 4.0 | Ordinary pressure | 85 | 4.0 |
| Comparative toner particles 7 | 85 | 3.0 | 100 | 4.0 | Ordinary pressure | 85 | 4.0 |
| Comparative toner particles 8 | 85 | 3.0 | 100 | 4.0 | Ordinary pressure | 65 | 4.0 |

TABLE 3

| | | Organosilicon polymer in toner particles | | | Particles having large particle diameter | | |
|---|---|---|---|---|---|---|---|
| Production example of toner particles | Organosilicon compound added during production of toner Kind | R carbon number (carbon atom(s)) | Ratio of peak area for partial structure represented by formula (1) (%) | ESCA dSi value (atomic %) | Kind | Volume average particle diameter (Dv) (nm) | Coefficient of variation in volume particle size distribution (%) |
| Toner particles 1 | Methyltriethoxysilane | 1 | 71.2 | 27.1 | Silica particles 1 | 105 | 13 |
| Toner particles 2 | Methyltriethoxysilane | 1 | 69.2 | 27.8 | Titania particles 1 | 275 | 18 |
| Toner particles 3 | Methyltriethoxysilane | 1 | 69.1 | 26.4 | PMMA particles 1 | 150 | 8 |
| Toner particles 4 | Butyltriethoxysilane | 4 | 42.0 | 12.0 | Silica particles 1 | 105 | 13 |
| Toner particles 5 | Hexyltriethoxysilane | 6 | 23.4 | 9.1 | Silica particles 1 | 105 | 13 |
| Toner particles 6 | Hexyltriethoxysilane | 6 | 6.3 | 6.0 | Silica particles 1 | 105 | 13 |
| Toner particles 7 | Hexyltriethoxysilane | 6 | 7.1 | 2.0 | Silica particles 1 | 105 | 13 |
| Toner particles 8 | Methyltriethoxysilane | 1 | 69.9 | 27.8 | Silica particles 2 | 24 | 15 |
| Toner particles 9 | Methyltriethoxysilane | 1 | 72.4 | 25.3 | Silica particles 3 | 610 | 16 |
| Toner particles 10 | Methyltriethoxysilane | 1 | 72.3 | 26.6 | Silica particles 4 | 110 | 22 |
| Toner particles 11 | Methyltriethoxysilane | 1 | 69.7 | 27.6 | Silica particles 1 | 105 | 13 |
| Toner particles 12 | Methyltriethoxysilane | 1 | 68.6 | 25.2 | Silica particles 1 | 105 | 13 |
| Toner particles 13 | Methyltriethoxysilane | 1 | 71.8 | 26.9 | Silica particles 1 | 105 | 13 |
| Toner particles 14 | Methyltriethoxysilane | 1 | 71.6 | 26.9 | Silica particles 1 | 105 | 13 |
| Toner particles 15 | Methyltriethoxysilane | 1 | 71.2 | 25.1 | Silica particles 1 | 105 | 13 |
| Toner particles 16 | Methyltriethoxysilane | 1 | 72.0 | 25.3 | Silica particles 5 | 110 | 12 |
| Toner particles 17 | Methyltriethoxysilane | 1 | 69.2 | 26.9 | Silica particles 1 | 105 | 13 |
| Comparative toner particles 1 | Hexyltriethoxysilane | 6 | 3.1 | 2.4 | Silica particles 1 | 105 | 13 |
| Comparative toner particles 2 | Hexyltriethoxysilane | 6 | 7.0 | 0.6 | Silica particles 1 | 105 | 13 |
| Comparative toner particles 3 | Methyltriethoxysilane | 1 | 68.2 | 26.7 | Silica particles 6 | 9 | 18 |

TABLE 3-continued

| Production example of toner particles | Organosilicon compound added during production of toner Kind | Organosilicon polymer in toner particles: R carbon number (carbon atom(s)) | Ratio of peak area for partial structure represented by formula (1) (%) | ESCA dSi value (atomic %) | Particles having large particle diameter: Kind | Volume average particle diameter (Dv) (nm) | Coefficient of variation in volume particle size distribution (%) |
|---|---|---|---|---|---|---|---|
| Comparative toner particles 4 | Methyltriethoxysilane | 1 | 70.9 | 26.3 | Silica particles 7 | 1,030 | 11 |
| Comparative toner particles 5 | Methyltriethoxysilane | 1 | 72.5 | 27.2 | Silica particles 8 | 130 | 40 |
| Comparative toner particles 6 | Methyltriethoxysilane | 1 | 70.2 | 26.4 | Silica particles 1 | 105 | 13 |
| Comparative toner particles 7 | Methyltriethoxysilane | 1 | 71.0 | 27.4 | Silica particles 1 | 105 | 13 |
| Comparative toner particles 8 | Methyltriethoxysilane | 1 | 72.1 | 26.6 | Silica particles 1 | 105 | 13 |

TABLE 4

| Toner particles | Weight average particle diameter of toner particles D4 (μm) | Ra (nm) | σRa/Ra | RSm (nm) | σRSm/RSm | RSm2/RSm1 |
|---|---|---|---|---|---|---|
| Toner particles 1 | 6.3 | 49.5 | 0.38 | 219 | 0.32 | 1.04 |
| Toner particles 2 | 6.4 | 52.6 | 0.36 | 234 | 0.28 | 1.04 |
| Toner particles 3 | 6.3 | 55.5 | 0.33 | 247 | 0.30 | 1.04 |
| Toner particles 4 | 6.6 | 54.4 | 0.35 | 230 | 0.31 | 1.06 |
| Toner particles 5 | 6.4 | 56.3 | 0.33 | 204 | 0.32 | 1.04 |
| Toner particles 6 | 6.4 | 57.4 | 0.37 | 231 | 0.30 | 1.05 |
| Toner particles 7 | 6.3 | 56.5 | 0.38 | 236 | 0.28 | 1.06 |
| Toner particles 8 | 6.3 | 13 | 0.33 | 234 | 0.30 | 1.03 |
| Toner particles 9 | 5.8 | 290 | 0.36 | 238 | 0.33 | 1.06 |
| Toner particles 10 | 6.5 | 50.6 | 0.57 | 243 | 0.35 | 1.03 |
| Toner particles 11 | 6.2 | 55.4 | 0.37 | 24 | 0.37 | 1.06 |
| Toner particles 12 | 6.1 | 55.8 | 0.34 | 489 | 0.29 | 1.03 |
| Toner particles 13 | 6.2 | 57.2 | 0.33 | 198 | 0.57 | 1.06 |
| Toner particles 14 | 6.1 | 49.5 | 0.37 | 232 | 0.31 | 1.16 |
| Toner particles 15 | 5.8 | 56.4 | 0.38 | 236 | 0.36 | 1.26 |
| Toner particles 16 | 6.0 | 50.3 | 0.32 | 380 | 0.30 | 1.05 |
| Toner particles 17 | 6.4 | 52.1 | 0.31 | 211 | 0.31 | 1.05 |
| Comparative toner particles 1 | 6.1 | 56.9 | 0.39 | 241 | 0.29 | 1.06 |
| Comparative toner particles 2 | 5.9 | 50.4 | 0.39 | 194 | 0.32 | 1.05 |
| Comparative toner particles 3 | 6.0 | 4.2 | 0.34 | 243 | 0.34 | 1.03 |
| Comparative toner particles 4 | 5.9 | 510 | 0.36 | 212 | 0.33 | 1.06 |
| Comparative toner particles 5 | 6.4 | 54.4 | 0.73 | 216 | 0.32 | 1.03 |
| Comparative toner particles 6 | 6.0 | 54.1 | 0.38 | 12 | 0.29 | 1.03 |
| Comparative toner particles 7 | 5.9 | 53.7 | 0.39 | 875 | 0.36 | 1.03 |
| Comparative toner particles 8 | 6.1 | 55.1 | 0.39 | 220 | 0.82 | 1.06 |

Example 1

Figure 4:
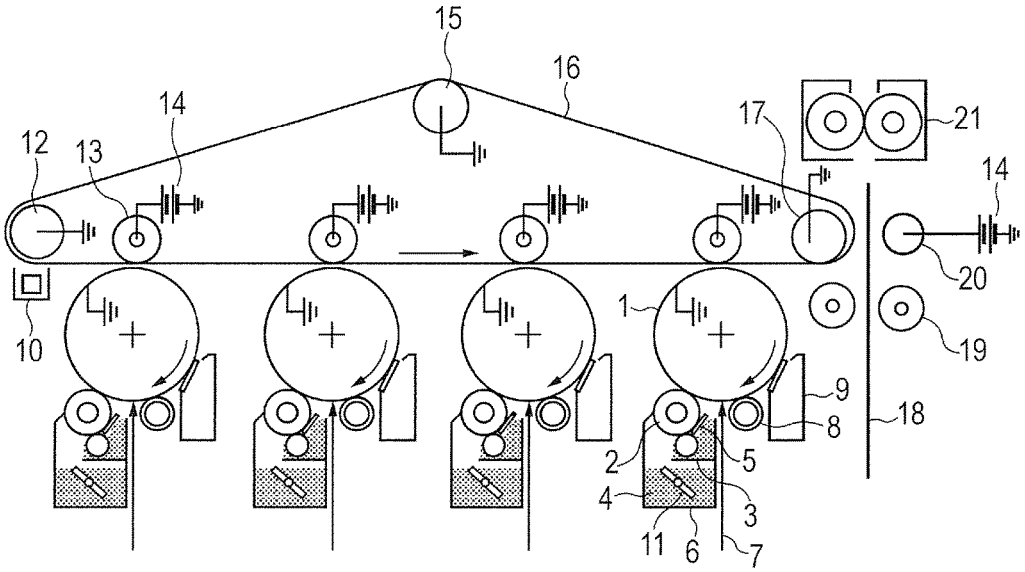
FIG. 4 is an illustration of an example of an electrophotographic apparatus to which the present invention is applicable.

A tandem-type laser beam printer LBP9510C manufactured by Canon Inc. having a configuration as illustrated in FIG. 4 was remodeled so as to be capable of performing printing only with a cyan station. The tandem-type laser beam printer LBP9510C was also remodeled so that a back contrast was able to be set arbitrarily. The tandem-type laser beam printer LBP9510C was also remodeled so that a transfer current was able to be set arbitrarily. It should be noted that, in FIG. 4, there are illustrated a photosensitive member 1, a developing roller 2, a toner supplying roller 3, a toner 4, a regulating blade 5, a developing device 6, laser light 7, a charging device 8, a cleaning device 9, a charging device for cleaning 10, a stirring blade 11, a driving roller 12, a transfer roller 13, a bias power source 14, a tension roller 15, a transfer conveyance belt 16, a driven roller 17, paper 18, a sheet feeding roller 19, an attracting roller 20, and a fixing device 21. A toner cartridge for the LBP9510C was used, and 200 g of the toner particles 1 were filled into the toner cartridge. Then, the toner cartridge was left to stand for 24 hours under a high-temperature and high-humidity (H/H) (32.5° C./85% RH) environment. After being left to stand for 24 hours under the high-temperature and high-humidity environment, the toner cartridge was mounted on the LBP9510C, and an image having a printing ratio of 1.0% was printed out onto 20,000 sheets of A4 paper in a lateral direction, and fogging latitudes, transfer latitudes, and image densities in an initial stage and after output of 20,000 sheets of paper (after endurance) were evaluated. The results are shown in Table 5.

<Evaluation of Fogging Latitude>

Figure 5:
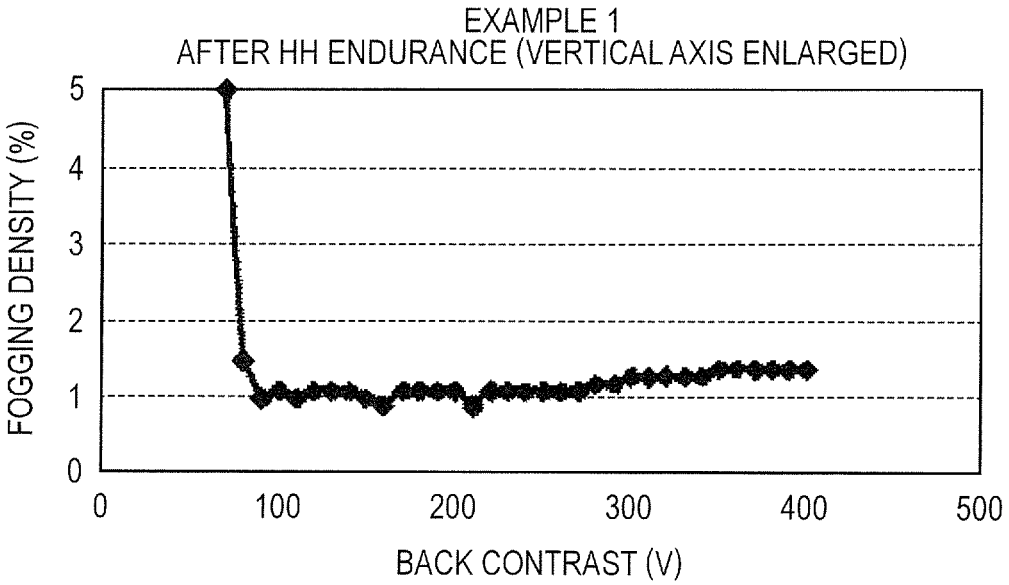
FIG. 5 is a graph for showing an example of a relationship between a back contrast and fogging in the present invention.

The back contrast was changed in 10 V steps from 40 V to 400 V, and an entire white image (image having a printing ratio of 0%) was printed in each step. An amber filter was mounted on a "reflectometer" (manufactured by Tokyo Denshoku Co., Ltd.), and thus fogging was measured. Further, this operation was performed in the initial stage and after printing of 20,000 sheets of paper. A measured value of fogging is a fogging density (%) obtained by subtracting a measured value of the entire white image from a measured value of unused paper. A measurement example is shown in FIG. 5, and a range in which the fogging density falls within 2.0% is defined as fogging latitude. When the fogging density is more than about 3.5%, an image failure tends to be recognized. Thus, it was determined that, when the fogging latitude was 90 V or more in which the fogging density fell within 2.0%, superiority of fogging control design was expressed.

Fogging latitude of 250 V or more: rank A

Fogging latitude of 150 V or more and less than 250 V: rank B

Fogging latitude of 90 V or more and less than 150 V: rank C

Fogging latitude of 50 V or more and less than 90 V: rank D

Fogging latitude of less than 50 V: rank E

<Evaluation of Transfer Latitude>

The transfer current was changed in 2 μA steps from 2 μA to 20 μA in the initial stage and after printing of 20,000 sheets of paper. A solid image was output in each step, and a transfer residual toner on the photosensitive member after transfer of the solid image was scraped off by taping of a Mylar tape. Then, the above-mentioned tape and a tape that was not used for taping were attached onto a letter-size XEROX 4200 sheet (manufactured by Xerox Corporation, 75 g/m$^2$). Transferability was evaluated based on a numerical value obtained by subtracting a reflectance Dr (%) of the tape attached to the sheet without being used for taping from a reflectance Ds (%) of the above-mentioned tape.

A transfer current range in which the numerical value of transferability was 2.0 or less was defined as transfer latitude.

The reflectance was measured by using "REFLECTMETER MODEL TC-6DS" (manufactured by Tokyo Denshoku. Co., Ltd.) with an amber filter mounted thereto.

Transfer latitude of 13 A or more: rank A

Transfer latitude of 10 A or more and less than 13 A: rank B

Transfer latitude of 7 A or more and less than 10 A: rank C

Transfer latitude of 4 A or more and less than 7 A: rank D

Transfer latitude of less than 4 A: rank E

<Image Density>

Image density was evaluated in the initial stage and after output of 20,000 sheets of paper. As a sheet, XEROX BUSINESS 4200 (manufactured by Xerox Corporation, 75 g/m$^2$) was used. A solid image was output, and the density thereof was measured, to thereby evaluate the image density. It should be noted that the image density was obtained by measuring relative density with respect to an image in a white ground portion having an original density of 0.00 through use of "Macbeth reflection densitometer RD918" (manufactured by Macbeth). In the evaluation of the present invention, the image density was ranked as follows. In the case where the image density was less than 1.20 in a rank E, the image density was determined to be unsatisfactory. Evaluation results are shown in Table 5.

Image density of 1.40 or more: rank A

Image density of 1.30 or more and less than 1.40: rank B

Image density of 1.25 or more and less than 1.30: rank C

Image density of 1.20 or more and less than 1.25: rank D

Image density of less than 1.20: rank E

Examples 2 to 17 and Comparative Examples 1 to 8

Each of the toner particles shown in Table 2 and Table 3 was evaluated for fogging latitude, transfer latitude and image density in the same way as in Example 1. Results are shown in Table 5.

TABLE 5

| | | HH environment | | | | | |
|---|---|---|---|---|---|---|---|
| | | Fogging latitude | | Transfer latitude | | Image density | |
| | | Initial | After endurance | Initial | After endurance | Initial | After endurance |
| Example 1 | Toner 1 | 320 V (A) | 310 V (A) | 18 A (A) | 16 A (A) | 1.45 (A) | 1.42 (A) |
| Example 2 | Toner 2 | 310 V (A) | 260 V (A) | 17 A (A) | 14 A (A) | 1.43 (A) | 1.40 (A) |
| Example 3 | Toner 3 | 310 V (A) | 240 V (B) | 17 A (A) | 13 A (A) | 1.43 (A) | 1.40 (A) |
| Example 4 | Toner 4 | 320 V (A) | 240 V (B) | 17 A (A) | 13 A (A) | 1.45 (A) | 1.41 (A) |
| Example 5 | Toner 5 | 300 V (A) | 230 V (B) | 17 A (A) | 12 A (B) | 1.44 (A) | 1.40 (A) |
| Example 6 | Toner 6 | 290 V (A) | 200 V (B) | 16 A (A) | 11 A (B) | 1.44 (A) | 1.38 (B) |
| Example 7 | Toner 7 | 270 V (A) | 170 V (B) | 15 A (A) | 10 A (B) | 1.43 (A) | 1.35 (B) |
| Example 8 | Toner 8 | 310 V (A) | 300 V (A) | 16 A (A) | 12 A (B) | 1.45 (A) | 1.42 (A) |
| Example 9 | Toner 9 | 320 V (A) | 300 V (A) | 15 A (A) | 10 A (B) | 1.45 (A) | 1.41 (A) |
| Example 10 | Toner 10 | 290 V (A) | 240 V (B) | 14 A (A) | 10 A (B) | 1.45 (A) | 1.41 (A) |
| Example 11 | Toner 11 | 320 V (A) | 310 V (A) | 17 A (A) | 15 A (A) | 1.45 (A) | 1.42 (A) |
| Example 12 | Toner 12 | 320 V (A) | 310 V (A) | 15 A (A) | 10 A (B) | 1.44 (A) | 1.40 (A) |
| Example 13 | Toner 13 | 320 V (A) | 310 V (A) | 14 A (A) | 10 A (B) | 1.44 (A) | 1.41 (A) |
| Example 14 | Toner 14 | 250 V (A) | 190 V (B) | 14 A (A) | 10 A (B) | 1.43 (A) | 1.38 (B) |
| Example 15 | Toner 15 | 240 V (B) | 170 V (B) | 13 A (A) | 9 A (C) | 1.43 (A) | 1.36 (B) |
| Example 16 | Toner 16 | 280 V (A) | 250 V (A) | 13 A (A) | 10 A (B) | 1.43 (A) | 1.40 (A) |
| Example 17 | Toner 17 | 290 V (A) | 270 V (A) | 12 A (A) | 10 A (A) | 1.44 (A) | 1.42 (A) |
| Comparative Example 1 | Comparative toner 1 | 190 V (B) | 80 V (D) | 10 A (B) | 6 A (D) | 1.43 (A) | 1.31 (B) |
| Comparative Example 2 | Comparative toner 2 | 170 V (B) | 70 V (D) | 10 A (B) | 5 A (D) | 1.43 (A) | 1.28 (C) |
| Comparative Example 3 | Comparative toner 3 | 170 V (B) | 70 V (D) | 10 A (B) | 5 A (D) | 1.43 (A) | 1.28 (C) |
| Comparative Example 4 | Comparative toner 4 | 300 V (A) | 250 V (A) | 11 A (B) | 6 A (D) | 1.43 (A) | 1.40 (A) |
| Comparative Example 5 | Comparative toner 5 | 300 V (A) | 240 V (B) | 10 A (B) | 6 A (D) | 1.42 (A) | 1.40 (A) |
| Comparative Example 6 | Comparative toner 6 | 250 V (A) | 130 V (C) | 10 A (B) | 6 A (D) | 1.40 (A) | 1.35 (B) |
| Comparative Example 7 | Comparative toner 7 | 300 V (A) | 240 V (B) | 8 A (C) | 4 A (D) | 1.43 (A) | 1.38 (B) |
| Comparative Example 8 | Comparative toner 8 | 300 V (A) | 240 V (B) | 9 A (C) | 6 A (D) | 1.43 (A) | 1.39 (B) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-079250, filed Apr. 8, 2015, which is hereby incorporated by reference herein in its entirety.

What is claimed is:

1. A toner, comprising a toner particle having a surface layer, the surface layer comprising an organosilicon polymer having a partial structure represented by formula (1):

$$R^0—SiO_{3/2} \quad (1)$$

where $R^0$ represents an alkyl group having 1 or more and 6 or less carbon atoms, or a phenyl group, wherein a ratio of a peak area for the partial structure represented by formula (1) to a total peak area for the organosilicon polymer is 5.0% or more in a $^{29}$Si-NMR measurement of a tetrahydrofuran-insoluble matter of the toner particle, a ratio of a destiny of a silicon dSi to a total density (dC+dO+dSi) of a density of a carbon atom dC, a density of an oxygen atom dO, and a density of the silicon atom dSi in the surface of the toner particle is 1.0to 28.6 atom % in X-ray photoelectron spectroscopic analysis of a surface of the toner particle, and an arithmetic average roughness Ra is 10 to 300 nm, σRa/Ra is 0.60 or less when a standard deviation of Ra is σRa, an average length RSm of a roughness curve element is 20 to 500 nm, and σRSm/RSm is 0.60 or less when a standard deviation of RSm is σRSm in a roughness curve of the toner particle measured by using a scanning probe microscope, with a proviso that Ra and RSm are defined by JIS B 0601-2001.

2. A toner according to claim 1, wherein RSm2/RSm1 is 1.20 or less where RSm1 represents an average length of a roughness curve element defined by JIS B 0601-2001 of the toner; and RSm2 represents an average length of the roughness curve element defined by JIS B 0601-2001 of a treated-toner obtained by subjecting the toner to centrifugation in a sucrose solution.

3. A toner according to claim 1, wherein the ratio of the peak area for the partial structure represented by formula (1) to the total peak area for the organosilicon polymer is 40.0% or more.

4. A toner according to claim 1, wherein $R^0$ in formula (1) represents a methyl group or an ethyl group.

5. A toner according to claim 1, wherein e RSm2/RSm1 of the toner is 1.10 or less.

6. A toner according to claim 1, wherein the surface layer of the toner particle further comprises a particle having a volume average particle diameter of 20 to 700 nm.

* * * * *